US008182062B2

(12) United States Patent
Inoue

(10) Patent No.: US 8,182,062 B2
(45) Date of Patent: May 22, 2012

(54) MAINTENANCE APPARATUS, LIQUID EJECTION APPARATUS AND NOZZLE SURFACE MAINTENANCE METHOD

(75) Inventor: Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 918 days.

(21) Appl. No.: 12/191,431

(22) Filed: Aug. 14, 2008

(65) Prior Publication Data

US 2009/0046122 A1 Feb. 19, 2009

(30) Foreign Application Priority Data

Aug. 17, 2007 (JP) ..... 2007-213011

(51) Int. Cl.
*B41J 2/165* (2006.01)

(52) U.S. Cl. ..... 347/33; 101/425

(58) Field of Classification Search ..... 347/33; 101/425

See application file for complete search history.

(56) References Cited

U.S. PATENT DOCUMENTS

| | | | | |
|---|---|---|---|---|
| 3,377,643 | A * | 4/1968 | Teng et al. | 15/118 |
| 3,657,003 | A * | 4/1972 | Kenney | 427/430.1 |
| 6,050,671 | A * | 4/2000 | Rotering | 347/35 |
| 6,361,142 | B1 * | 3/2002 | Otsuka et al. | 347/36 |
| 2003/0087982 | A1 * | 5/2003 | Kanazawa | 522/49 |

FOREIGN PATENT DOCUMENTS

| | | | |
|---|---|---|---|
| JP | 11-58752 | A | 3/1999 |
| JP | 2002361879 | A * | 12/2002 |
| JP | 2005-96125 | A | 4/2005 |

OTHER PUBLICATIONS

JP Office Action issued in JP application No. 2007-213011 dated Nov. 15, 2011.

* cited by examiner

*Primary Examiner* — Charlie Peng
*Assistant Examiner* — Peter Radkowski
(74) *Attorney, Agent, or Firm* — Birch, Stewart, Kolasch & Birch, LLP

(57) ABSTRACT

A maintenance apparatus for a nozzle surface in which a plurality of nozzles ejecting a liquid are formed, in an ejection head having a nozzle row in which the nozzles are aligned in a main scanning direction, has: a liquid storage member which is disposed in a position opposing the nozzle surface of the ejection head at a prescribed distance from the nozzle surface, and which has a liquid holding surface which has a length, in a sub-scanning direction perpendicular to the main scanning direction, corresponding to a length in the sub-scanning direction of a region in which the plurality of nozzles are provided; a liquid supply device which supplies a liquid to the liquid holding surface; a movement device which moves the liquid storage member through a whole length of the nozzle row in the main scanning direction, while bringing the liquid held on the liquid holding surface into contact with the nozzle surface; and a wiping device which wipes the nozzle surface that has been wetted by the liquid supplied to the liquid storage member, while moving subsequently to the liquid storage member, to remove adhering material attached to the nozzle surface.

20 Claims, 11 Drawing Sheets

MAINTENANCE APPARATUS, LIQUID EJECTION APPARATUS AND NOZZLE SURFACE MAINTENANCE METHOD

BACKGROUND OF THE INVENTION

1. Field of the Invention

The present invention relates to a maintenance apparatus, a liquid ejection apparatus and a nozzle surface maintenance method, and more particularly to technology for maintaining the liquid ejection surface of a liquid ejection head.

2. Description of the Related Art

In general, an inkjet recording apparatus which forms a desired image by ejecting ink droplets from a head onto a recording medium is widely used as a generic image forming apparatus. In an inkjet recording apparatus, when ink, dust, or the like which has been scattered during ejection adheres to the nozzle surface of a head, then the ink ejection direction may deflected so that displacement can occur in the ink depositing positions, and a prescribed amount of ink may not be ejected from the nozzles, so that ejection abnormalities may occur. Consequently, an inkjet recording apparatus is composed in such a manner that the adhering material which is attached to the nozzle surface of the head is removed at periodic intervals.

A lyophobic film is formed on the nozzle surface of the head, with a view to maintaining prescribed ejection performance. When the nozzle surface is wiped by means of a blade, in order to remove the adhering material on the nozzle surface, the lyophobic film on the nozzle surface may be damaged, and this degradation of the lyophobic film may cause a decline in the ejection performance. A variety of methods which carry out a wiping process after wetting the nozzle surface have been proposed as a countermeasure to this.

Furthermore, Japanese Patent Application Publication No. 2005-96125 discloses a method for cleaning a nozzle plate in which a cleaning plate is disposed at a position opposing the nozzle plate, a solution, such as an ink, is filled in between the nozzle plate and the cleaning plate, and by then increasing the distance between the nozzle plate and the cleaning plate, the solution present between the nozzle plate and the cleaning plate is moved to the cleaning plate, and hence the nozzle plate is cleaned without damaging the nozzle plate.

However, in a method which wets the nozzle surface and then wipes the nozzle surface using a blade, generally, the wetting process requires approximately the same amount of processing time as the wiping process, and therefore approximately twice the processing time is required in comparison with a method which carries out a wiping process only. When it is sought to wet the nozzle surface in a short space of time, it is necessary to make the size of the apparatus used to carry out the wetting process correspond to the size of the head, and hence the apparatus used for the wetting process becomes large in size.

Furthermore, if it is sought to carry out the wetting process in a short period of time, non-uniformities may occur in the wetting of the nozzle surface, and this is undesirable from the viewpoint of protecting the lyophobic film. In particular, in cases where a full line type of head is provided, it is desirable to prevent the increase in the wetting process time and the size of the apparatus used to carry out the wetting process.

Furthermore, if the invention described in Japanese Patent Application Publication No. 2005-96125 is applied to a full line head, then problems of the following kinds arise.

If the length of the cleaning plate is shorter than the length of the line head in the lengthwise direction, then it is necessary to repeat the same process a plurality of times in order to carry out maintenance of the whole head. On the other hand, when the cleaning plate is composed to a length which corresponds to the length of the line head in the lengthwise direction thereof, if it is sought to carry out the maintenance of the whole head in one step, then although this contributes to shortening the processing time, the cleaning plate and the movement mechanism of the cleaning plate become large in size, and consequently, the overall size of the apparatus increases and furthermore, this leads to increase in the overall costs of the apparatus.

Moreover, in the invention described in Japanese Patent Application Publication No. 2005-96125, there is no flow in the solution which is present between the nozzle plate and the cleaning plate, and hence there is a concern that when the ink of increased viscosity adhering to the nozzle surface and the adhering material caused by the ink are cleaned, only a diffusing action serves to promote the dissolution of these ink and adhering material, and hence the adhering material cannot be dissolved in a short period of time, and the time required for cleaning (maintenance time period) becomes long.

Moreover, in the method illustrated in FIGS. 3(a) to 3(f) in Japanese Patent Application Publication No. 2005-96125, there is also a possibility that since the cleaning plate is tilted when the solution present between the nozzle plate and the cleaning plate is moved toward the cleaning plate, the solution spreads out over the cleaning plate, and the interior of the apparatus may be soiled by the solution which has dropped outside the cleaning plate therefrom. Furthermore, in the method illustrated in FIGS. 4(a) to 4(d) in Japanese Patent Application Publication No. 2005-96125, since the cleaning plate is moved in parallel, then there is a possibility that the nozzle surface can become soiled due to the adhering material, which has been moved into the solution on the cleaning plate, becoming reattached to the nozzle surface. In other words, in the methods illustrated in FIGS. 3(a) to 3(f) and FIG. 4(a) to 4(d) of the Japanese Patent Application Publication No. 2005-96125, in any case, it is difficult to clean the nozzle surface without soiling the nozzle plate or the interior of the apparatus, or to recover the solution used for cleaning the nozzle plate.

SUMMARY OF THE INVENTION

The present invention has been contrived in view of these circumstances, an object thereof being to provide a maintenance apparatus, a liquid ejection apparatus, and a nozzle surface maintenance method, whereby maintenance of the liquid ejection surface can be carried out efficiently, in a short space of time, by means of a space-saving composition.

In order to attain the aforementioned object, the present invention is directed to a maintenance apparatus for a nozzle surface in which a plurality of nozzles ejecting a liquid are formed, in an ejection head having a nozzle row in which the nozzles are aligned in a main scanning direction, the maintenance apparatus comprising: a liquid storage member which is disposed in a position opposing the nozzle surface of the ejection head at a prescribed distance from the nozzle surface, and which has a liquid holding surface which has a length, in a sub-scanning direction perpendicular to the main scanning direction, corresponding to a length in the sub-scanning direction of a nozzle arrangement region in which the plurality of nozzles are provided; a liquid supply device which supplies a liquid to the liquid holding surface; a movement device which moves the liquid storage member through a whole length of the nozzle row in the main scanning direction, while bringing the liquid held on the liquid holding surface into contact with the nozzle surface; and a wiping device which wipes the nozzle surface that has been wetted by the liquid supplied to the liquid storage member, while moving subsequently to the liquid storage member, to remove adhering material attached to the nozzle surface.

In this aspect of the invention, since the liquid is supplied to the ink holding surface of the liquid storage member which is disposed at a position opposing the nozzle surface of the ejection head, and the liquid storage member is moved through the whole length of the nozzle row in the main scanning direction while the liquid held on the liquid holding surface is caused to come into contact with the nozzle surface, then it is possible to wet the nozzle arrangement region of the nozzle surface of the ejection head, in a short period of time.

Moreover, since the nozzle surface is wiped after wetting the nozzle surface by means of the liquid held on the liquid holding surface, then it is possible reliably to dissolve and remove the ink of the increased viscosity and adhering material, such as dirt and paper dust, which are attached to the nozzle surface. Furthermore, since the nozzle surface wiping process uses a wet wiping process, then scratching or abrasion of the hydrophobic film on the nozzle surface is prevented.

Desirably, a mode is adopted in which a wiping device is disposed at a prescribed interval from the ink storage member on the upstream side in terms of the movement direction of the ink storage member, and the ink storage member and the wiping device are moved in unison.

Desirably, the liquid holding surface has a supply port through which the liquid supplied from the liquid supply device is sent.

In this aspect of the invention, it is suitable to use a desirable liquid for wetting the nozzle surface, and improvement in cleaning performance can be anticipated.

A desirable mode is one in which the liquid supply device comprises a liquid supply channel connected to the supply port, and a liquid storage device which stores the liquid to be supplied to the liquid holding section via the supply port.

Desirably, the liquid supply device comprises the ejection head.

In this aspect of the invention, it is possible to simplify the composition of the apparatus, without needing to provide a separate composition for supplying the liquid to the ink holding surface.

A desirable mode is one comprising a judgment device which judges the position of the ink storage member, and supplies the liquid from the ejection head in accordance with the position of the ink storage member on the basis of the judgment results of the judgment device.

In a mode where liquid is supplied to the liquid holding surface from the ejection head, then it is desirable to provide an internal pressure modification device which adjusts the internal pressure of the ejection head, and an internal pressure control device which controls the internal pressure modification device, and during the liquid supply, the internal pressure modification device is controlled by the internal pressure control device to adjust the internal pressure of the ejection head to a positive pressure.

Desirably, the liquid holding surface has an inclined surface of a structure in which a distance from the nozzle surface in an end portion of the liquid holding surface on an upstream side in terms of a direction of movement of the liquid storage member is greater than a distance from the nozzle surface in an end portion of the liquid holding surface on a downstream side in terms of the direction of the movement of the liquid storage member.

In this aspect of the invention, since a flow in the direction opposite to the movement direction is generated in the liquid on the liquid holding surface, then it is possible to dissolve and separate the adhering material on the nozzle surface, in a short period of time.

Desirably, the liquid storage member comprises a liquid recovery channel which is provided in at least an end portion of the liquid holding surface on an upstream side in terms of a direction of movement of the liquid storage member and which recovers the liquid supplied to the liquid holding surface.

In this aspect of the invention, since the liquid overflowing from the liquid holding surface (liquid storage member) is recovered into the liquid recovery channel, then there is no soiling of the perimeter of the head by the liquid which has overflowed from the liquid holding surface.

If the liquid recovery channel is provided about the full circumference of the outer perimeter portion of the liquid holding surface, then it is possible to respond to overflowing of liquid from any direction on the liquid holding surface, which is more desirable.

Desirably, the liquid holding surface is provided at least partially with a lyophilic treatment.

In this aspect of the invention, it is possible to ensure the wetting properties of the liquid holding surface with respect to the liquid, and therefore the liquid wets and spreads over the liquid holding surface and the liquid can be held on the surface more readily.

A desirable mode is one in which a hydrophilic treatment is provided on a region of the liquid holding surface including the central portion in terms of the direction of movement of the maintenance apparatus, and a more desirable mode is one in which a hydrophilic treatment is provided on the region of the liquid holding surface other than an end portion(s).

Desirably, a hydrophobic treatment is provided on an end portion of the liquid holding surface on a downstream side in terms of a direction of movement of the liquid storage member.

In this aspect of the invention, it is possible to ensure hydrophobic properties in the end portion of the liquid holding surface on the downstream side in the direction of movement of the liquid holding member, and therefore the outflow of liquid to the exterior from the end portion of the liquid holding surface on the downstream side in the direction of movement of the liquid holding member is prevented, and the liquid can be held more readily on the liquid holding surface, as well as facilitating the recovery of liquid from the liquid holding surface.

A desirable mode is one in which a boundary between a hydrophilic treatment and a hydrophobic treatment is provided in the end portion of the liquid holding surface on the downstream side in the direction of the movement.

In order to attain the aforementioned object, the present invention is also directed to a liquid ejection apparatus, comprising: an ejection head having a nozzle surface in which a plurality of nozzles ejecting a liquid are formed and a nozzle row in which the nozzles are aligned in a main scanning direction; a liquid storage member which is disposed in a position opposing the nozzle surface of the ejection head at a prescribed distance from the nozzle surface, and which has a liquid holding surface which has a length, in a sub-scanning direction perpendicular to the main scanning direction, corresponding to a length in the sub-scanning direction of a nozzle arrangement region in which the plurality of nozzles are provided; a movement device which moves the liquid storage member through a whole length of the nozzle row in the main scanning direction, while bringing a liquid supplied from the ejection head and held on the liquid holding surface, into contact with the nozzle surface; and a wiping device which wipes the nozzle surface that has been wetted by the liquid supplied to the liquid storage member, while moving subsequently to the liquid storage member, to remove adhering material attached to the nozzle surface.

The liquid ejection apparatus includes an inkjet recording apparatus which forms images on a recording medium by ejecting ink from nozzles. In a mode where heads are provided for respective colors in order to provide color image recording, a desirable aspect is one where maintenance devices each including a liquid storage member, a movement device, and a wiping device, are provided for the heads respectively (i.e. a maintenance device is provided for each head). Of course, it is also possible to provide a common maintenance device for a plurality of heads, and to move this maintenance device between the heads.

Apart from ink, the liquid ejected onto an ejection receiving medium may be any liquid having properties which allow it to be ejected from nozzles, such as a pattern forming body like a liquid resist, a resin liquid containing resin microparticles, a treatment liquid which displays prescribed functions when interacting with ink, or the like, or water, a liquid chemical, or the like.

Desirably, the ejection head comprises a line type ejection head which has at least one nozzle row in which the nozzles which eject the liquid are arranged in the main scanning direction through a length corresponding to a length of one edge of an ejection receiving medium.

The line type of ejection head may include a mode constituted by combining together a plurality of head blocks.

Desirably, the liquid ejection apparatus further comprises: an internal pressure modification device which adjusts an internal pressure of the ejection head; and an internal pressure control device which controls the internal pressure modification device in such a manner that the internal pressure of the ejection head is set to a positive pressure when the liquid is supplied from the ejection head to the liquid storage member.

The internal pressure control device controls the internal pressure modification device in such a manner that the internal pressure of the ejection head becomes a negative pressure during ejection of liquid or during ejection standby on the basis of the ejection data.

The positive pressure and negative pressure referred to here have the following relationship: positive pressure>atmospheric pressure>negative pressure.

Desirably, the internal pressure modification device comprises: a sub tank connected to the ejection head; and a pressurization device which pressurizes a liquid in the sub tank.

A desirable mode is one which uses a sealed sub tank in which the internal liquid is sealed from the atmosphere. In a mode which uses an open sub tank in which the liquid inside the sub tank is connected to the outside air, an elevator device which raises and lowers the sub tank is provided, and the internal pressure of the head can be changed by means of the liquid head pressure differential between the sub tank and the head.

Desirably, the liquid ejection apparatus further comprises: ejection force application devices which are provided for the plurality of nozzles respectively, and which respectively apply ejection forces to the liquid in the plurality of nozzles; and an ejection control device which controls operation of the ejection force application devices in such a manner that when the liquid is supplied from the ejection head to the liquid storage member, the liquid is supplied to the liquid storage member via the nozzles.

In this aspect of the invention, the liquid is caused to flow out selectively from the plurality of nozzles provided in the ejection head, and the liquid can thereby be supplied to the liquid storage member.

For the ejection force application devices, it is desirable to use piezoelectric elements which are provided on or form a wall surface constituting a pressure chamber connected to a nozzle, or heaters (heating devices) which generate a film boiling phenomenon in the liquid inside the pressure chambers.

The ejection control device may include a control signal generating device which generates control signals to be applied to the ejection force generating devices.

Desirably, the ejection control device controls the ejection force application devices in such a manner that the liquid is ejected onto the liquid storage member selectively from the nozzles on a downstream side in terms of a direction of movement of the liquid storage member.

In this aspect of the invention, it is possible to generate a flow of the liquid on the liquid holding surface, while also contributing to reduction in the amount of liquid consumed.

Desirably, the ejection head includes a plurality of head blocks aligned in the main scanning direction, and the internal pressure modification devices are provided for the plurality of head blocks respectively; and the internal pressure control device which controls the internal pressure modification devices provided for the plurality of head blocks respectively, in such a manner that the liquid is supplied to the liquid storage member from the head block directly below which the liquid storage member is positioned.

In this aspect of the invention, by setting the internal pressure to a negative pressure in a head block which is not participating in the supply of liquid, then leaking of the liquid from the nozzles is prevented.

Desirably, the internal pressure control device controls the internal pressure modification devices to set an internal pressure of the head block from which the liquid is caused to flow out from the nozzles, to a positive pressure and to set an internal pressure of the head block which is wiped by the wiping device to atmospheric pressure.

In this aspect of the invention, by setting the internal pressure to atmospheric pressure in a head block which is being subject to a wiping process, then the adhering material on the nozzle surface, and air, are prevented from entering inside the nozzles.

In order to attain the aforementioned object, the present invention is also directed to a maintenance method for a nozzle surface in which a plurality of nozzles are formed, in an ejection head having a nozzle row in which the nozzles ejecting a liquid are arranged in a main scanning direction, the maintenance method comprising the steps of: supplying a liquid to a liquid storage member which is disposed at a position opposing the nozzle surface at a prescribed distance from the nozzle surface, and which comprises a liquid holding surface having a length, in a sub-scanning direction perpendicular to the main scanning direction, corresponding to a length in the sub-scanning direction of a nozzle arrangement region in which the plurality of nozzles are arranged; and moving the liquid storage member through a whole length of the nozzle row in the main scanning direction while causing the liquid held on the liquid holding surface to make contact with the nozzle surface, and wiping the nozzle arrangement region of the nozzle surface which has been wetted by the liquid supplied to the liquid storage member, to remove adhering material attached to the nozzle surface.

A desirable mode is one which includes: a mode switching step of switching between a normal ejection mode for performing ejection on the basis of the ejection data and a maintenance mode for performing maintenance of the nozzle surface; and a movement step of moving the maintenance device having the ink storage member from a prescribed withdrawn position to a maintenance position directly below the head, when the device has transferred to the maintenance step.

Furthermore, in a mode having a structure in which a plurality of head blocks are aligned in the head, a desirable mode is one in which a nozzle surface wiping step is carried out in the adjacent head block on the upstream side in terms of the direction of movement of the ink storage member with respect to the head block in which a nozzle surface wetting step is being carried out.

In other words, a desirable mode is one where, in two mutually adjacent head blocks, the head block on the downstream side in terms of the direction of movement of the ink storage member is subjected to a nozzle surface wetting step, while the head block on the upstream side in terms of the direction of movement of the ink storage member is subjected to a nozzle surface wiping step. It is also possible that there is a head block which has completed the wetting step and which are awaiting the wiping step, between a head block where the nozzle surface wetting step is to be carried out and a head block where the nozzle surface wiping step is to be carried out.

According to the present invention, liquid is supplied to the ink holding surface of the liquid storage member which is disposed at a position opposing the nozzle surface of the ejection head, and the liquid storage member is moved through the whole length of the nozzle row in the main scanning direction, while causing the liquid supplied to the liquid holding surface to come into contact with the nozzle surface; therefore, it is possible to wet the nozzle surface, in a short period of time.

Moreover, since the nozzle surface is wiped after wetting the nozzle surface by means of the liquid supplied to the liquid holding surface, then it is possible reliably to remove the ink of the increased viscosity and adhering material, such as dirt and paper dust, which are attached to the nozzle surface. Furthermore, since the nozzle surface wiping process uses a wet wiping process, then scratching or abrasion of the hydrophobic film on the nozzle surface is prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
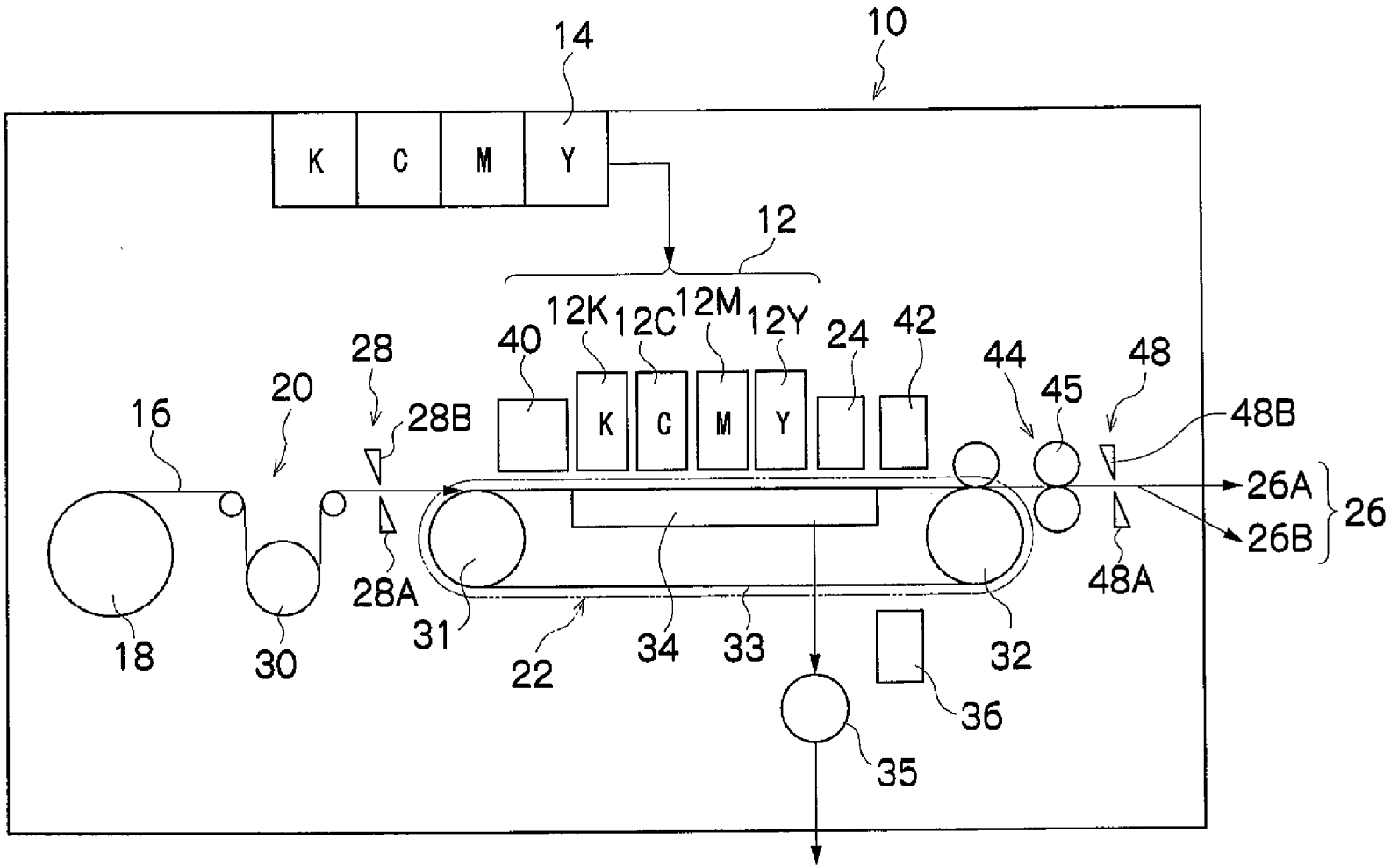
FIG. 1 is a general schematic drawing of an inkjet recording apparatus relating to an embodiment of the present invention.

FIG. 1 is a schematic drawing showing the general composition of an inkjet recording apparatus 10 relating to an embodiment of the present invention. As shown in FIG. 1, the inkjet recording apparatus 10 comprises: a print unit 12 having a plurality of inkjet heads (hereinafter, called heads) 12K, 12C, 12M, and 12Y provided for ink colors of black (K), cyan (C), magenta (M), and yellow (Y), respectively; an ink storing and loading unit 14 for storing inks to be supplied to the heads 12K, 12C, 12M and 12Y; a paper supply unit 18 for supplying recording paper 16 forming a recording medium (ejection receiving medium); a decurling unit 20 for removing curl in the recording paper 16; a suction belt conveyance unit 22, disposed facing the nozzle faces of the respective heads 12K, 12C, 12M and 12Y, for conveying the recording paper 16 while keeping the recording paper 16 flat; a print determination unit 24 for reading the printed result produced by the print unit 12; and a paper output unit 26 for outputting a recorded recording paper (printed matter) to the exterior.

The ink storage and loading unit 14 comprises ink storage tanks (not shown in FIG. 1 and indicated by reference numeral 60 in FIG. 5) which store inks of the colors corresponding to the respective heads 12K, 12C, 12M and 12Y, and the inks of the respective colors are connected to the heads 12K, 12C, 12M and 12Y via prescribed ink flow channels.

The ink storing and loading unit 14 also comprises a warning device (for example, a display device or an alarm sound generator) for warning when the remaining amount of any ink is low, and has a mechanism for preventing loading errors between different colors. The details of the ink supply system including the ink storing and loading unit 14 shown in FIG. 1 are described below.

In FIG. 1, a magazine for rolled paper (continuous paper) is shown as an example of the paper supply unit 18; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

After decurling, the cut recording paper 16 is delivered to the suction belt conveyance unit 22. The suction belt conveyance unit 22 has a structure in which an endless belt 33 is wound about rollers 31 and 32, in such a manner that at least the portion thereof which opposes the nozzle surfaces of the heads 12K, 12C, 12M and 12Y (the ink ejection surfaces in which nozzle openings are formed; not shown in FIG. 1 and indicated by reference numeral 50A in FIG. 5) form a horizontal surface (flat surface).

The belt 33 has a width that is greater than the width of the recording paper 16, and a plurality of suction apertures (not shown) are formed on the belt surface. A suction chamber 34 is disposed in a position facing the nozzle surfaces of the heads 12K, 12C, 12M, 12Y on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, and indicated by reference numeral 88 in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
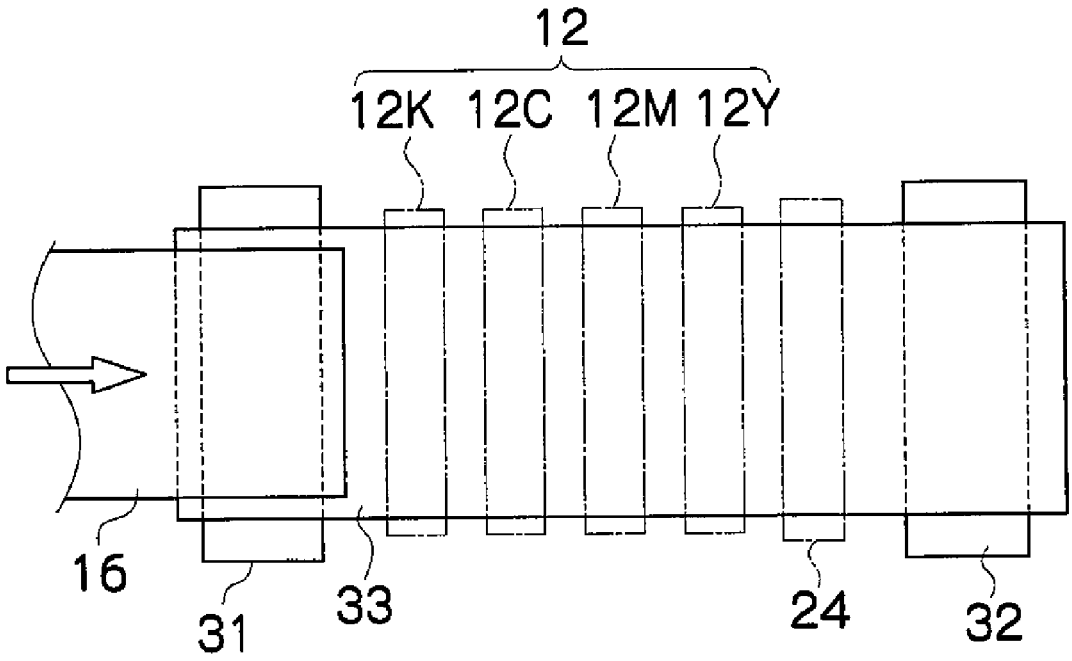
FIG. 2 is a principal plan diagram of the peripheral area of a print unit in the inkjet recording apparatus illustrated in FIG. 1.

The heads 12K, 12C, 12M and 12Y of the print unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed arranged in the conveyance direction (paper feed direction) of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction, in other words, by means of a single sub-scanning action. By adopting a composition which is capable of single-pass printing in this way, higher-speed printing is made possible and productivity can be improved in comparison with a shuttle type head configuration in which a recording head moves reciprocally in a direction which is perpendicular to the paper conveyance direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged. In an inkjet recording apparatus based on a two-liquid system in which treatment liquid and ink are deposited on the recording paper 16, and the ink coloring material is caused to aggregate or become insoluble on the recording paper 16, thereby separating the ink solvent and the ink coloring material on the recording paper 16, it is possible to provide an inkjet head as a device for depositing the treatment liquid onto the recording paper 16.

The print determination unit 24 has an image sensor for capturing an image of the ink-droplet deposition result of the print unit 12, and functions as a device to check for ejection abnormalities such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) photoreceptor element row composed of photoelectric transducing elements (pixels) arranged in a line provided with an R filter, a green (G) photoreceptor element row with a G filter, and a blue (B) photoreceptor element row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head 12K, 12C, 12M, and 12Y is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

When the recording paper 16 is pressed against the heating and pressurizing unit 44, then if, for instance, a dye-based ink has been printed onto a porous paper, this has beneficial effects of increasing the weatherproofing of the image by closing the pores of the paper by pressurization, and thereby preventing the ink from coming into contact with elements which may cause the dye molecules to break down, such as ozone, and the like.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Although not shown in FIG. 1, a maintenance unit (not shown in FIG. 1 and indicated by reference numeral 100 in FIG. 5) is provided in order to carry out maintenance of the nozzle surfaces of the heads 12K, 12C, 12M and 12Y. By using this maintenance unit to carry out maintenance of the nozzle surfaces of the heads 12K, 12C, 12M and 12Y, at periodic intervals or as and when required, then the prescribed ejection performance of the heads 12K, 12C, 12M and 12Y is maintained.

Structure of the Head

Next, the structure of a head will be described. The heads 12K, 12C, 12M and 12Y of the respective ink colors have the same structure, and a reference numeral 50 is hereinafter designated to any of the heads.

Figure 3A:
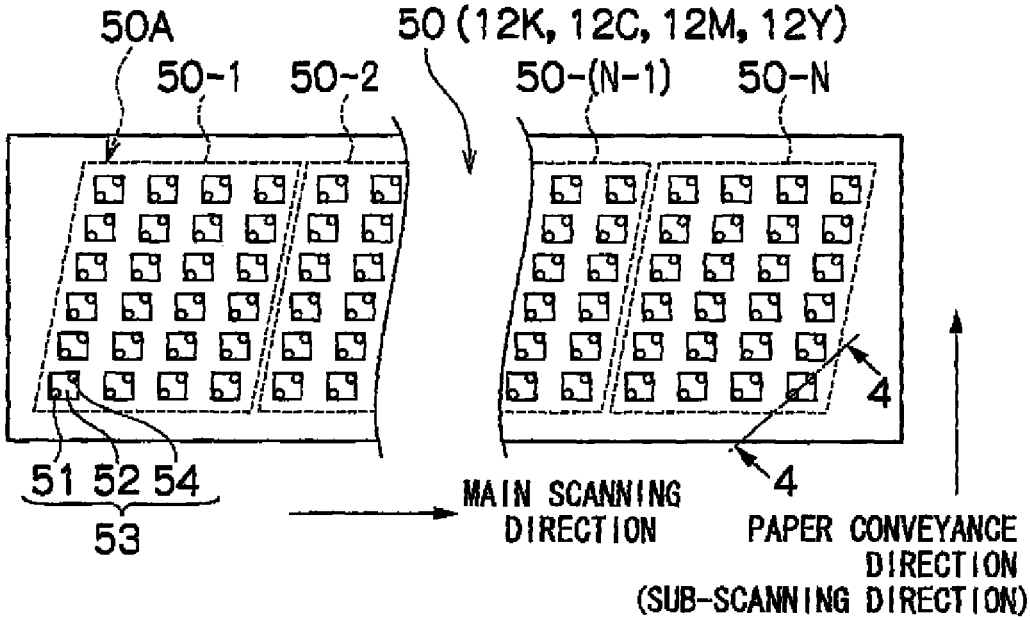
FIGS. 3A to 3C are plan view perspective diagrams showing examples of the composition of a print head.
Figure 3B:
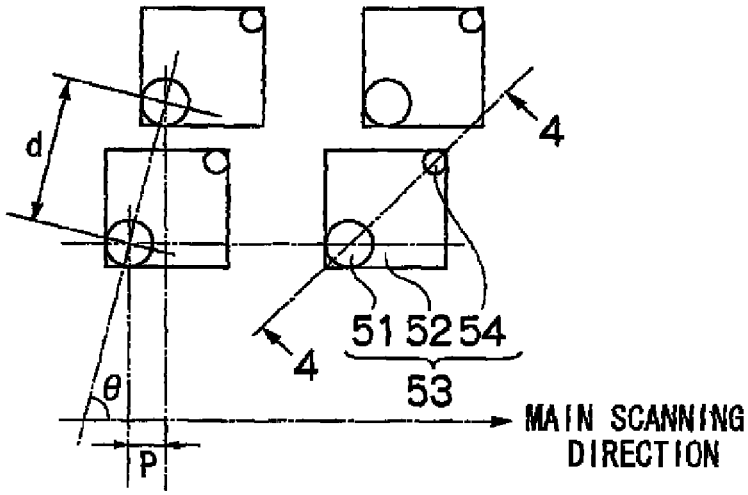
Figure 3C:
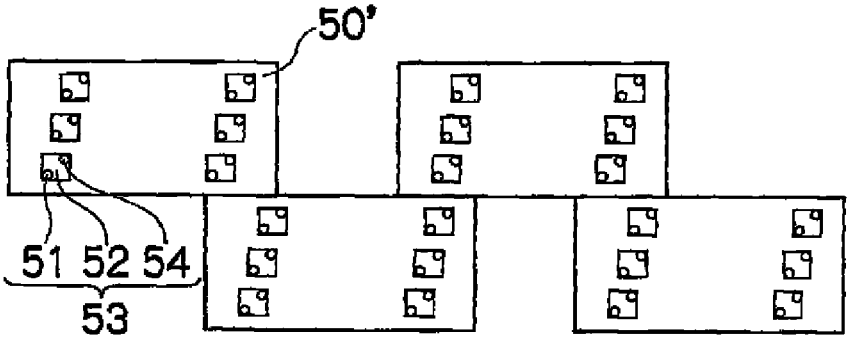
Figure 4:
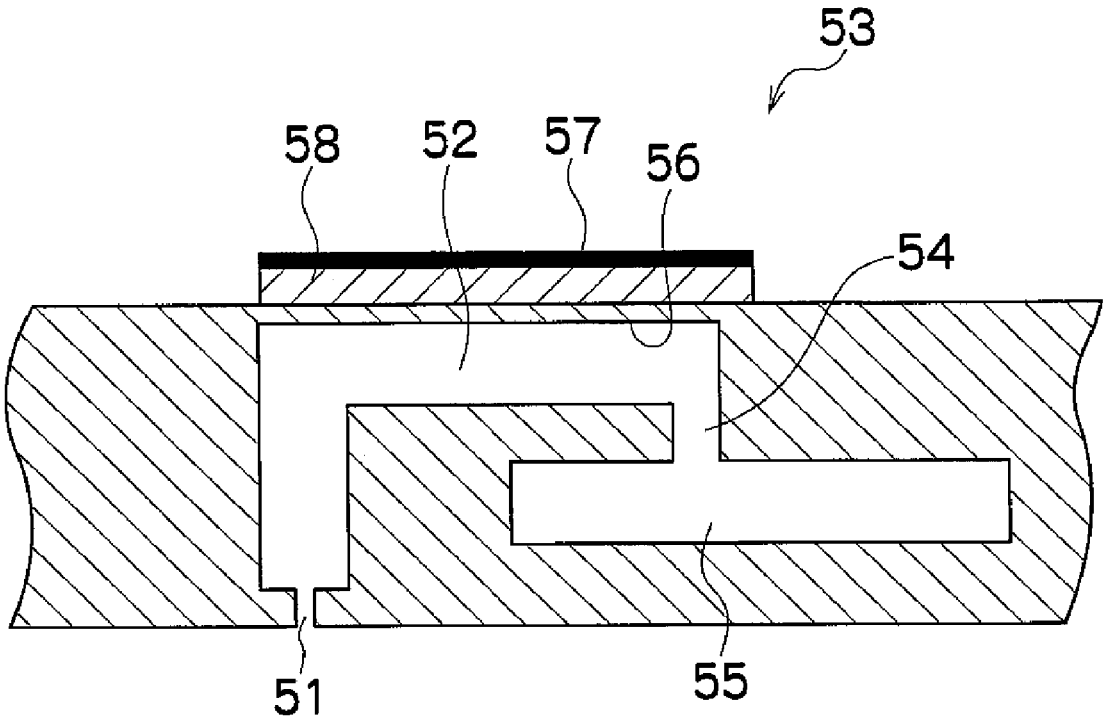
FIG. 4 is a cross-sectional diagram along line 4-4 in FIGS. 3A and 3B.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of head 50.

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head 50 (the main scanning direction perpendicular to the paper conveyance direction) is reduced and high nozzle density is achieved.

The mode of forming one or more nozzle rows through a length corresponding to the entire width of the recording paper 16 in a main scanning direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head units 50' having a plurality of nozzles 51 arrayed in a two-dimensional fashion. Furthermore, although not shown in the drawings, it is also possible to compose a line head by arranging short head units in one row.

The pressure chambers 52 provided corresponding to the respective nozzles 51 are each approximately square-shaped in plan view, and a nozzle 51 and a supply port 54 are provided respectively at either corner of a diagonal of each pressure chamber 52. Each pressure chamber 52 is connected via the supply port 54 to a common flow channel 55. The common flow channel 55 is connected to an ink supply tank which forms an ink source (not shown in FIGS. 3A to 3C, and indicated by reference numeral 60 in FIG. 5). The ink supplied from the ink supply tank is distributed and supplied to the pressure chambers 52 via the common flow channel 55 in FIG. 4.

A piezoelectric element 58 formed with an individual electrode 57 is bonded to a diaphragm 56 which forms the upper face of the pressure chamber 52 and also serves as a common electrode, and the piezoelectric element 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

In the present example, a piezoelectric element 58 is used as a pressurization device which pressurizes ink to be ejected from a nozzle 51 provided in a head 50, but for the pressurization device, it is also possible to employ a thermal method in which a heater is provided inside the pressure chamber 52 and ink is ejected by using the pressure of the film boiling action caused by the heating action of this heater.

As shown in FIG. 3B, the high-density nozzle head according to the present example is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the examples shown in the drawings, and it is also possible to apply various other types of nozzle arrangements, such as an arrangement structure having one nozzle row in the sub-scanning direction.

The head 50 shown in the present embodiment has a structure which is divided into N blocks following the main scanning direction, which is perpendicular to the paper conveyance direction. From the left-hand side in FIG. 3A, these are, in order: a first head block 50-1, a second head block 50-2, an $(N-1)^{th}$ head block 50-(N−1) and an $N^{th}$ head block 50-N. The head block 50-K (K=1, 2, . . . , N) comprises at least one nozzle row 51A in which a plurality of nozzles 51 are arranged in the row direction which forms an angle of θ with respect to the main scanning direction. FIG. 3A shows an example of a mode where four nozzle rows are provided in one head block 50-K.

The head 50 is constituted in such a manner that ink ejection can be controlled and the internal pressure can be controlled, independently and respectively in each head block. The number of nozzle rows contained in each head block 50-K and the number of head blocks 50-K can be changed as appropriate in accordance with the total number of nozzles 51. Furthermore, the number of nozzle groups included in each head block 50-K may vary between the head blocks (the head blocks may have different the number of nozzle groups).

FIG. 3A shows an example of a mode in which a head 50 comprising a plurality of head blocks 50-K is formed in an integrated fashion, but, for example, it is possible to compose one head 50 by forming a plurality of head blocks 50-K and then combining these plurality of head blocks 50-K together.

Configuration of an Ink Supply System

Figure 5:
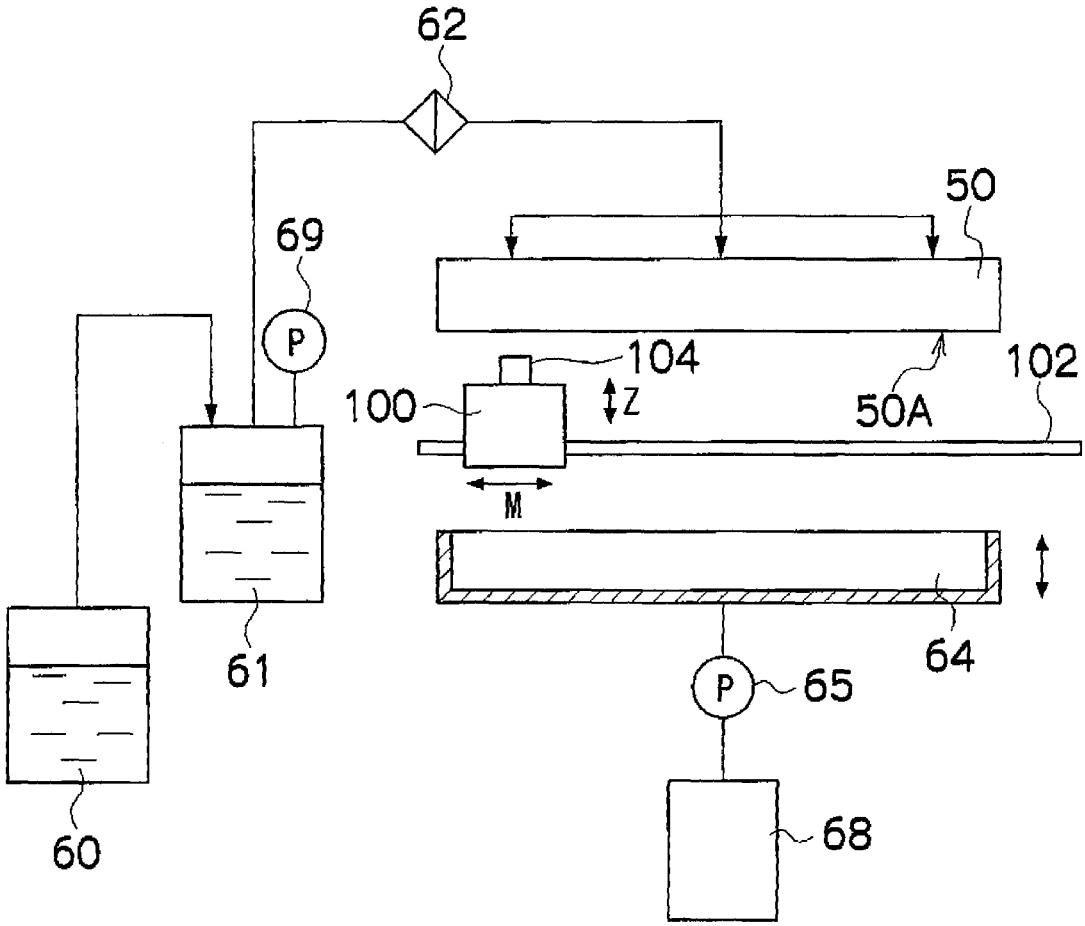
FIG. 5 is a conceptual diagram showing the composition of an ink supply system of the inkjet recording apparatus shown in FIG. 1.

FIG. 5 is a schematic drawing showing the configuration of the ink supply system in the inkjet recording apparatus 10. The ink supply tank 60 is a base tank that supplies ink to the head 50 and is included in the ink storing and loading unit 14 described with reference to FIG. 1. The modes of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

As shown in FIG. 5, a sub tank 61 which functions as an internal pressure modification device for the head 50, and a filter 62 for removing foreign matter and air bubbles, are provided between the ink supply tank 60 and the head 50.

The sub tank 61 is provided in the vicinity of the head 50 or in an integrated fashion with the head 50, and when a pump 69 which is attached to the sub tank 61 is operated, the internal pressure of the sub tank 61 changes, and the internal pressure of the head 50 also changes. Furthermore, the sub tank 61 also functions as a device for improving the damping effects and the refilling performance, by preventing internal pressure variations in the head 50. In the present example, a sealed sub tank is used which seals the ink in the sub tank 61 from the atmosphere.

FIG. 5 shows a sealed sub tank 61, but it is also possible to use an open type of sub tank, in which the ink inside the sub tank 61 is connected to the air. In a mode which uses an open sub tank, an elevator mechanism is provided to move the sub tank 61 in the vertical direction, and hence the internal pressure of the head 50 can be altered by means of the water head pressure difference between the head 50 and the sub tank 61. In a mode which uses an open type of sub tank, the pump 69 can be omitted from the composition.

The inkjet recording apparatus 10 shown in the present example comprises sub tanks 61 and pumps 69 of the same number as the head blocks (not shown in FIG. 5, and indicated by the reference numerals 50-1 to 50-N in FIG. 3A) (see FIGS. 7A and 7B), but in FIG. 5, only one sub tank and one pump are depicted, to represent the plurality of sub tanks and the plurality of pumps. In other words, in the ink supply system shown in the present example, ink supply channels are provided which connect from the ink supply tank 60 to the respective sub tanks 61-K, and hence the ink is distributed and supplied from the ink supply tank 60 to the plurality of sub tanks 61-K.

The filter mesh size of the filter 62 shown in FIG. 5 is preferably equivalent to or less than the diameter of the nozzles and is commonly about 20 μm.

The inkjet recording apparatus 10 is also provided with a cap 64 as a device to prevent the nozzles 51 from drying out or to prevent an increase in the ink viscosity in the vicinity of the nozzles 51. The cap 64 can be moved relatively with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 51, even if the piezoelectric element 58 is operated.

Therefore, before a situation of this kind develops (namely, while the ink is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

Furthermore, if air bubbles enter into the ink inside the head 50 (inside the pressure chamber 52), then even if the piezoelectric element 58 is operated, it may not be possible to eject ink from the nozzle. In a case of this kind, the cap 64 is placed on the head 50, the ink (ink containing air bubbles) inside the pressure chamber 52 is removed by suction, by means of a suction pump 65, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, a mode in which preliminary ejection is carried out when the increase in the viscosity of the ink is still minor, is preferable.

Furthermore, the ink et recording apparatus 10 shown in the present example comprises a maintenance unit 100 for removing adhering material, such as ink or paper dust, which is attached to the nozzle surface 50A of the head 50. The maintenance unit 100 shown in FIG. 5 is composed so as to be movable between a maintenance position directly below the head 50, which opposes the nozzle surface 50A of the head 50, and a withdrawn position which is distanced from the head 50, by means of a movement mechanism (not illustrated). FIG. 5 shows a state where the maintenance unit 100 is disposed in the maintenance position.

Furthermore, the inkjet recording apparatus 10 comprises a horizontal movement mechanism 102 for moving the maintenance unit 100 back and forth following the lengthwise direction of the head 50 which is perpendicular to the paper conveyance direction, while keeping the distance between the maintenance unit 100 and the nozzle surface 50A of the head 50, to a uniform distance, as well as a vertical movement mechanism 104 for moving the maintenance unit 100 in a parallel direction to the ink ejection direction (the vertical direction in FIG. 5).

In FIG. 5, the direction of the movement by means of the horizontal movement mechanism 102 is indicated by reference numeral M, the direction of the movement by means of the vertical movement mechanism 104 is indicated by reference numeral Z, and the horizontal movement mechanism 102 and the vertical movement mechanism 104 are depicted in a simplified fashion. One example of a composition of the horizontal movement mechanism 102 is one comprising: a carriage on which the maintenance unit 100 and the vertical movement mechanism 104 are installed; a guide which supports the carriage and which is provided in a parallel direction to the movement direction of the carriage; a drive system, such as a ball screw or a belt drive mechanism, which moves the carriage bearing the maintenance unit 100, and the like, back and forth in a parallel direction to the main scanning direction; and a motor which forms a drive source of the drive system.

Furthermore, one compositional example of the vertical movement mechanism 104 is one comprising a supporting member which supports the maintenance unit 100, a drive system, such as a ball screw or belt drive mechanism, which moves the supporting member that supports the maintenance unit 100 in a perpendicular direction with respect to the nozzle surface 50A of the head 50, and a motor which forms the drive source of the drive system. Furthermore, it is also possible to adopt a mode which uses an actuator in which the drive system and the drive source are formed in an integrated fashion.

Description of Control System

Figure 6:
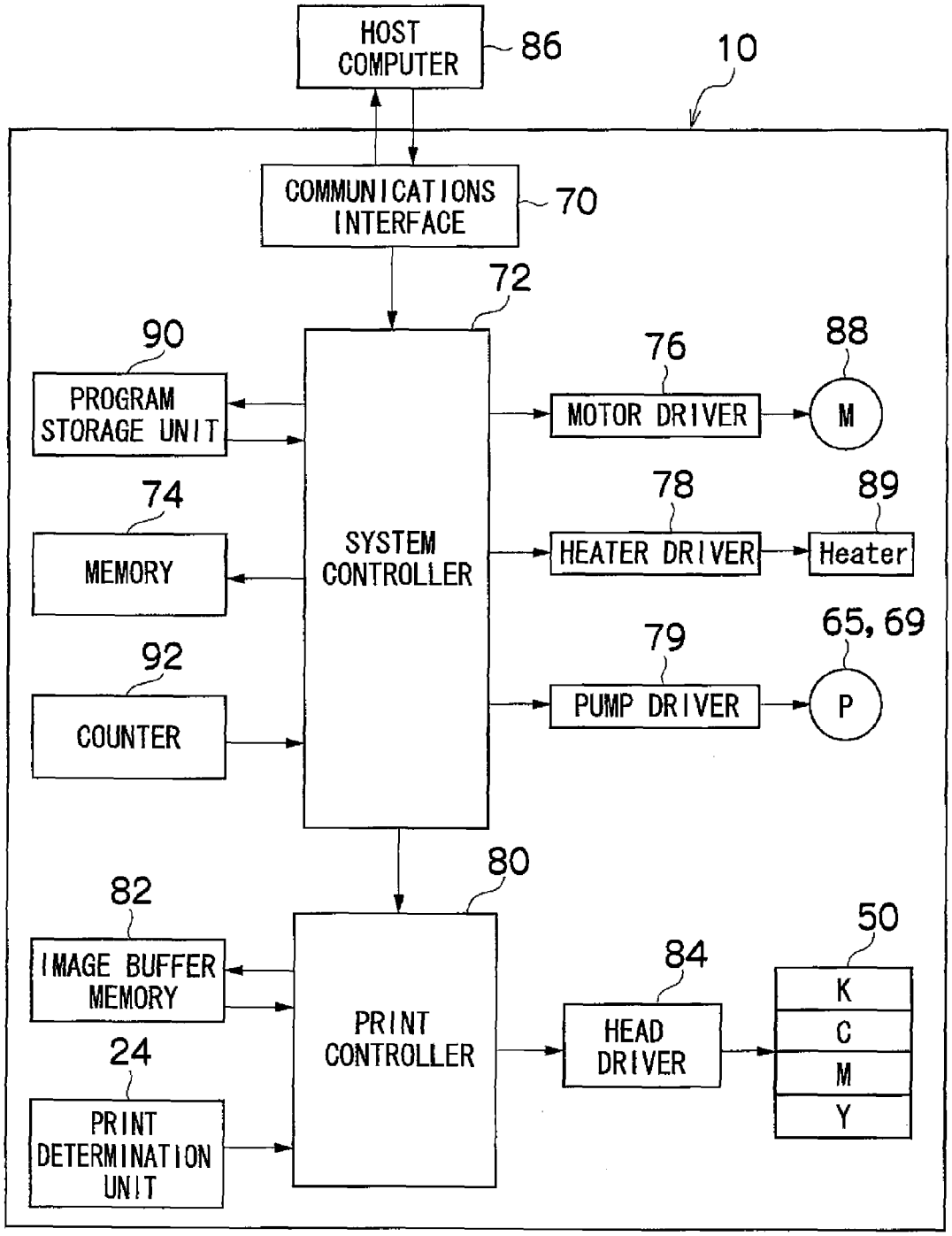
FIG. 6 is a conceptual diagram showing the composition of a control system of the inkjet recording apparatus shown in FIG. 1.

FIG. 6 is a principal block diagram showing the system configuration of the inkjet recording apparatus 10. The inkjet recording apparatus 10 comprises a communications interface 70, a system controller 72, a memory 74, a motor driver 76, a heater driver 78, a pump driver 79, a print control unit 80, an image buffer memory 82, a head driver 84, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with prescribed programs, as well as a calculation device for performing various calculations. More specifically, the system controller 72 controls the various sections, such as the communications interface 70, memory 74, motor driver 76, heater driver 78, pump driver 79, and the like, as well as controlling communications with the host computer 86 and writing and reading to and from the memory 74, and it also generates control signals for controlling the motor 88 of the conveyance system and the heater 89.

Programs executed by the CPU of the system controller 72 and various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver which drives the motor 88 in accordance with instructions from the system controller 72. In FIG. 6, the motors (actuators) disposed in the respective sections of the apparatus are represented by the reference numeral 88. For example, the motor 88 shown in FIG. 6 includes a motor which drives the drum 30 in FIG. 1, a motor of the movement mechanism which moves the cap 64 in FIG. 5, and motors forming drive sources of the horizontal movement mechanism 102 and the vertical movement mechanism 104 in FIG. 5, and the like.

The heater driver 78 is a driver which drives heaters 89 including a heater forming a heat source of the heating fan 40 shown in FIG. 1, a heater of the post drying unit 42, and the like, in accordance with instructions from the system controller 72.

The pump driver 79 is a functional block which controls the operation of the pump 65 attached to the cap 64 shown in FIG. 5 and the pump 69 which is attached to the sub tank 61 and controls the internal pressure of the head 50 in accordance with instructions from the system controller 72.

For example, in the maintenance processing for the nozzle surface 50A using the maintenance unit 100 shown in FIG. 5, when the internal pressure of the head 50 is changed to a positive pressure, then the system controller 72 sends a command signal to the pump driver 79, and the pump driver 79 drives the pump 69, thus controlling the internal pressure of the head 50, in accordance with command signals supplied by the system controller 72.

The print controller 80 has a signal processing function for performing various tasks, compensations, and other types of processing for generating print control signals from the image data stored in the memory 74 in accordance with commands from the system controller 72 so as to supply the generated print data (dot data) to the head driver 84. Required signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. Also possible is a mode in which the print controller 80 and the system controller 72 are integrated to form a single processor.

The head driver 84 generates drive signals to be applied to the piezoelectric elements 58 of the head 50, on the basis of image data supplied from the print controller 80, and also comprises drive circuits which drive the piezoelectric elements 58 by applying the drive signals to the piezoelectric elements 58. A feedback control system for maintaining constant drive conditions in the head 50 may be included in the head driver 84 shown in FIG. 6.

As shown in FIG. 1, the print determination unit 24 is a block including a line sensor, which reads in the image printed onto the recording paper 16, performs various signal processing operations, and the like, and determines the print situation (presence/absence of ejection, variation in droplet ejection, and the like). The print determination unit 24 supplies these determination results to the print controller 80.

According to requirements, the print controller 80 makes various corrections and maintenance with respect to the head 50 on the basis of information obtained from the print determination unit 24.

The image data to be printed is externally inputted through the communications interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided. The program storage section 90 may also be combined with a storage device for storing operational parameters, and the like (not shown).

A counter 92 which is connected to the system controller 72 is a functional block which counts the drive signals (pulse signals) to the motors that are the drive sources of the horizontal movement mechanism 102 and the vertical movement mechanism 104 of the maintenance unit 100 shown in FIG. 5. A controllable motor, such as a servo motor, or the like, is used for the motors which are the drive sources of the horizontal movement mechanism 102 and the vertical movement mechanism 104, and by counting the number of pulses of the pulse-shaped drive signal which are applied to the motor driver 76, it is possible to ascertain the amount of operation of the motors (in other words, the amount of movement of the maintenance unit 100).

It is also possible to provide an operational amount determination device, such as an encoder, in the motors forming the drive sources of the horizontal movement mechanism 102 and the vertical movement mechanism 104, and to ascertain the position (amount of movement) of the maintenance unit 100 on the basis of the count value of the number of output pulses from the encoder, as counted by the counter 92; or alternatively, it is also possible to provide a position determination device, such as a linear encoder, in the horizontal movement mechanism 102 and the vertical movement mechanism 104, count the number of output signals of the position determination device, and ascertain the position of the maintenance unit 100 on the basis of the count value of the number of output signals of the position determination device.

DESCRIPTION OF MAINTENANCE UNIT

First Embodiment

Figure 7A:
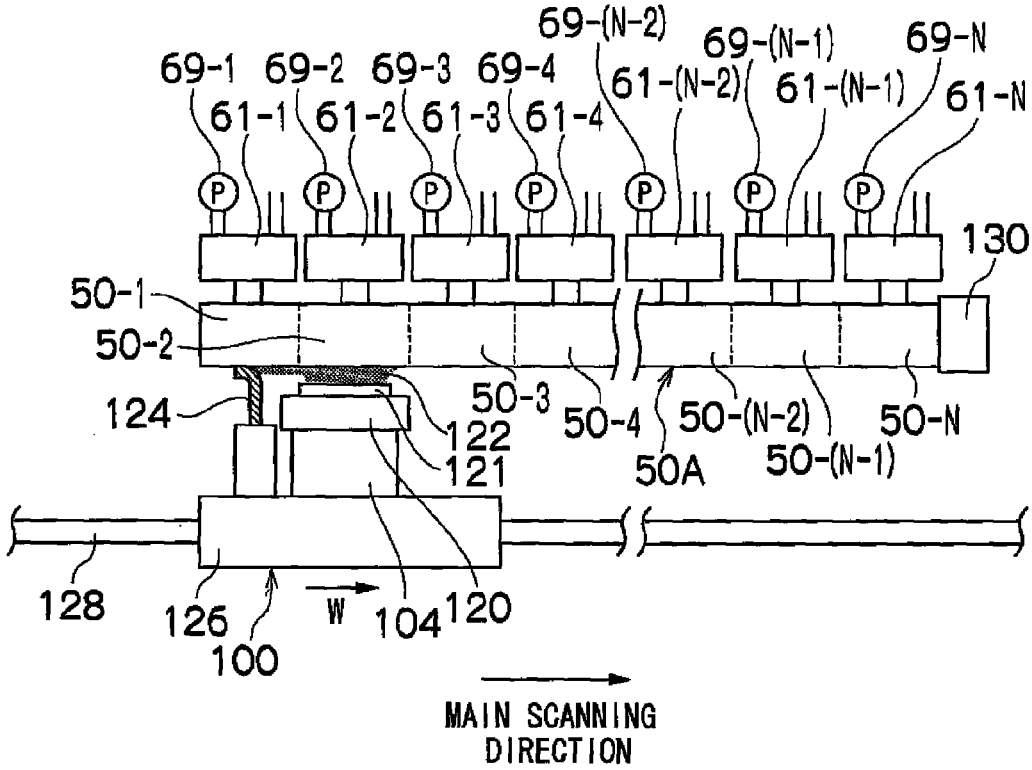
FIGS. 7A and 7B are illustrative diagrams of the maintenance apparatus shown in FIG. 5.
Figure 7B:
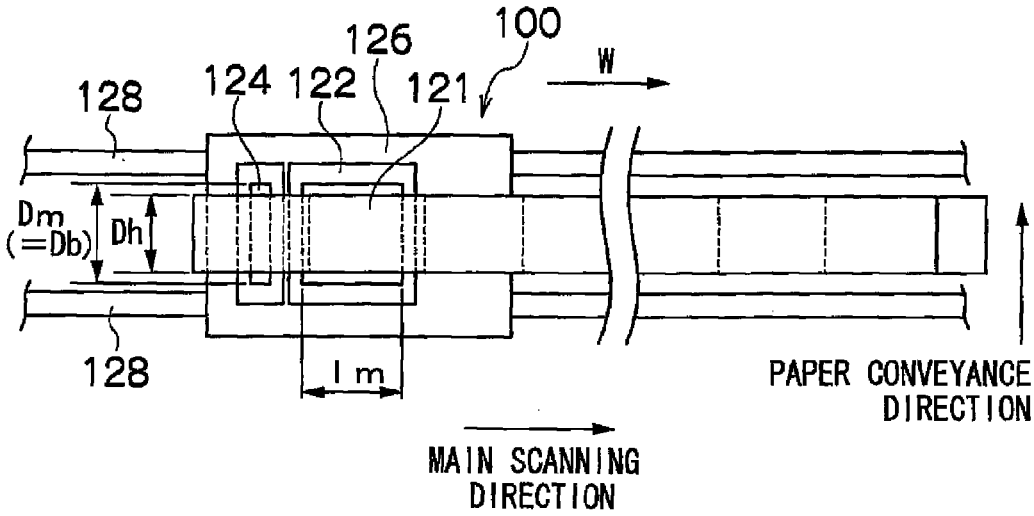

Next, the maintenance unit 100 according to a first embodiment of the present invention will be described. FIG. 7A is a diagram showing a state during maintenance processing using a maintenance unit 100, as viewed from the side face of the head 50 (the side of one end of the head 50 in the lengthwise direction), and FIG. 7B is a diagram of the state shown in FIG. 7A as viewed from the upper side of the head 50 (the opposite side with respect to the ink ejection direction).

As shown in FIG. 7A, during the carrying out of maintenance processing of the nozzle surface 50A, the maintenance unit 100 is disposed in a maintenance position which is directly below the head 50 and which opposes the nozzle surface 50A of the head 50, and the maintenance unit 100 is moved through the full length of the head 50 in the lengthwise direction (main scanning direction), in a scanning direction W which following the lengthwise direction of the head 50, in order to perform maintenance processing of the nozzle surface 50A. The maintenance processing referred to here includes processing for removing adhering material, such as ink (solidified ink) which has become attached to the nozzle surface 50A, paper dust, dirt, and the like, from the nozzle surface 50A.

The maintenance unit 100 comprises an ink storage member 120 having an ink holding surface 121 on the face which opposes the ink nozzle surface 50A of the head 50, and ink 122 is supplied to the ink holding surface 121 from the head 50, via the nozzles (see FIG. 4), in accordance with the movement of the ink storage member 120.

The ink 122 supplied to the ink holding surface 121 adheres to the nozzle surface 50A and thereby wets (moistens) the nozzle surface 50A, and the wetted nozzle surface 50A is then wiped by means of a blade 124 which moves to follow the ink storage member 120. When the nozzle surface 50A is wiped by the blade 124, the adhering material attached to the nozzle surface 50A and the ink which has wetted the nozzle surface 50A is removed.

FIG. 7A shows a state where ink 122 is supplied to the ink holding surface 121 from the nozzles belonging to the head block 50-2, and furthermore, the head block 50-1 is wiped by the blade 124.

As shown in FIG. 7B, the relationship between the width of the ink holding surface 121 (the length of the ink holding surface 121 in the breadthways direction of the head 50) $D_m$, and the length $D_h$ of the head 50 in the breadthways direction satisfy $D_m > D_h$. Similarly, the relationship between the width of the blade 124 which is provided on the upstream side of the ink storage member 120 in the scanning direction W (the length of the blade 124 in the breadthways direction of the head 50) $D_b$, and the length of the head 50 in the breadthways direction $D_h$, satisfy $D_b > D_h$. In FIG. 7B, the ink holding surface 121 and the blade 124 have the same width ($D_m = D_b$).

Furthermore, the length $l_m$ of the ink holding surface 121 in the lengthwise direction of the head has the following relationship with respect to the scanning speed of the maintenance unit 100. If the scanning speed of the maintenance unit 100 is relatively slow, then even if the length $l_m$ of the ink holding surface 121 in the lengthwise direction of the head is relatively short, it is possible to ensure that the time period during which the ink held on the ink holding surface 121 remains in contact with the nozzle surface 50A (the time period during which the adhering material attached to the nozzle surface 50A is dissolved), is equal to or greater than a prescribed time period. On the other hand, if the scanning speed of the maintenance unit 100 is relatively fast, then by making the length $l_m$ of the ink holding surface 121 in the lengthwise direction of the head a relatively large length, it is possible to ensure that the time period during which the ink held on the ink holding surface 121 lies in contact with the nozzle surface 50A is equal to or greater than a prescribed time period.

In other words, the length $l_m$ of the ink holding surface 121 in the lengthwise direction of the head can be specified on the basis of the time period during which the ink held on the ink holding surface 121 is to lie in contact with the nozzle surface 50A (the time period required in order to dissolve the adhering material which is attached to the nozzle surface 50A and originates from ink).

The time period required to dissolve the adhering material originating from ink, from the nozzle surface 50A, depends on the ink properties, and therefore it is desirable to evaluate this time period in advance. If this time period is defined as the dissolution time, then the required length $l_m$ in the lengthwise direction of the head is given by: the required length $l_m$=scanning speed (moving speed) of maintenance unit 100 (mm/sec)×dissolution time.

In the case of the ink used in the present embodiment, it was possible to obtain a good wiping action with a dissolution time of three seconds or above. On the other hand, the scanning speed of the maintenance unit 100 was set to 20 (mm/sec), on the basis of the maintenance processing time conditions. Therefore, in the present example, the required length $l_m$ of the ink holding surface 121 in the lengthwise direction of the head is $l_m$=20 (mm/sec)×3 (sec)=60 mm.

The maintenance unit 100 comprises a carriage 126 which is supported by a guide 128 that extends in the main scanning direction, and has a structure in which the ink storage member 120 and the blade 124 are mounted on the carriage 126, in such a manner that the ink storage member 120 and the blade 124 move in a unified fashion.

The disposition interval between the ink holding surface 121 and the blade 124 in the scanning direction W (the distance between the end portion of the ink holding surface 121 on the downstream side in the scanning direction W and the end portion of the blade 124 on the downstream side in the scanning direction W) is desirably set to a length corresponding to the length of the head block in the main scanning direction. For example, if a composition is adopted in which the blade 124 is positioned at the wiping start position of the head block 50-(K−1) when the ink holding surface 121 is positioned at the wetting start position of the head block 50-K, then it is possible to carry out a wiping process of the immediately previous head block 50-(K−1) simultaneously with carrying out a wetting process with respect to the head block 50-K, and hence a maintenance process can be carried out with good efficiency. A desirable mode is one where a fine adjustment mechanism is provided to carry out fine adjustment of the position of the blade 124 in the scanning direction W.

Of course, the head block in which a wetting process is carried out and the head block in which a wiping process is carried out do not have to be consecutive head blocks, and blocks in which the wetting process has been completed and which are in a standby state for the wiping process may be included between the head block in which a wetting process is being carried out and the head block in which a wiping process is being carried out.

As described above, the maintenance unit 100 shown in the present example is able to carry out a maintenance process over the whole of the nozzle surface 50A of the head 50, by performing one scanning action in the main scanning direction (by means of a single pass action of the maintenance unit 100).

If the distance between the nozzle surface 50A and the ink holding surface 121 is equal to or greater than 1 mm and equal to or less than 5 mm, then it is possible to hold the ink 122 between the nozzle surface 50A and the ink holding surface 121. Thereby, the ink 122 can be caused to lie in contact with the nozzle surface 50A, and the nozzle surface 50A can be prevented from being damaged due to the ink holding surface 121 making contact with the nozzle surface 50A when the maintenance unit 100 is moved directly below the head 50.

The head 50 shown in FIG. 7A has N head blocks 50-K (K=1, 2, . . . , N) which are indicated by the reference numerals from 50-1 to 50-N, and sub tanks 61-1 to 60-N and pumps 69-1 to 69-N are provided for the respective head blocks 50-K, in such a manner that the internal pressure of each head block 50-K can be controlled respectively and independently.

In the head block directly above the ink holding surface 121 (the head block 50-2 in FIG. 7A), ink is supplied to the ink holding surface 121 by altering the internal pressure to a positive pressure (namely, a pressure greater than the atmospheric pressure). Furthermore, the internal pressure in the head block in which a wiping process is being carried out by the blade 124 (the head block 50-1 in FIG. 7A), is controlled to the atmospheric pressure, while the internal pressure in the head blocks in which neither ink supply (a wetting process) nor a wiping process are being carried out, is controlled to a negative pressure (namely, a pressure smaller than the atmospheric pressure) in such a manner that the ink does not leak out from the nozzles.

When supplying ink 122 to the ink storage member 120, it is possible either to cause ink to flow out from all of the nozzles of the head block 50-K, or to cause ink to flow out from a portion of the nozzles. Moreover, it is also possible to supply ink in a continuous fashion, or to supply ink in an intermittent fashion.

When the ink is caused to flow out from a portion of the nozzles of the head block 50-K, the internal pressure of the head block 50-K is controlled in such a manner that ink is caused to project out from all or a portion of the nozzle openings in the head block 50-K, and in the portion of nozzles from which the ink is to flow out, a drive signal is applied to the piezoelectric elements for the corresponding nozzles (either a drive signal which is the same as the drive signal used to eject ink is applied a plurality of times, or a drive signal having a longer on time than the drive signal used to eject ink is applied), thereby operating the corresponding piezoelectric elements and causing ink to flow out. If ink is supplied intermittently, then the piezoelectric elements are desirably operated in an intermittent fashion.

The maintenance unit 100 is moved from one end portion of the head 50 in the lengthwise direction, to the other end portion, in the scanning direction W, while a state in which the ink supplied from the head 50 via the nozzles is held temporarily on the ink storage member 120 is maintained; therefore, the whole of the nozzle surface 50A can be wetted efficiently in a short period of time without any shortages of ink, while the meniscus between the ink storage member 120 and the nozzle surface 50A is maintained.

Moreover, fresh ink is supplied from the head block 50-K directly above the ink storage member 120 in accordance with the movement of the maintenance unit 100, and furthermore, a flow is created in the ink 122 between the nozzle surface 50A and the ink storage member 120 due to the movement of the maintenance unit 100, thereby causing the adhering material attached to the nozzle surface 50A to dissolve quickly into the ink 122 present between the nozzle surface 50A and the ink storage member 120, and preventing any stagnation between the nozzle surface 50A and the ink storage member 120 of ink 122 having a high concentration of dirt due to the dissolution of adhering material therein. Consequently, the adhering material which has been transferred from the nozzle surface 50A and into the ink 122 is prevented from becoming reattached to the nozzle surface 50A.

Having reached the end portion of the head 50 on the downstream side in terms of the scanning direction, the maintenance unit 100 is then separated from the head 50 by a greater distance than the distance during maintenance (in such a manner that the distance between the nozzle surface 50A and the ink holding surface 121 is greater than 5 mm, for example), and the maintenance unit 100 is then moved to the end portion of the head 50 on the upstream side in terms of the scanning direction. A mode is also possible in which the maintenance unit 100 is scanned (moved) back and forth reciprocally.

In other words, a rotating mechanism which rotates the maintenance unit 100 through 180° is provided, thereby achieving a composition in which, when the maintenance unit 100 reaches the end portion of the head 50 on the downstream side in the scanning direction, the maintenance unit 100 is temporarily moved out beyond a position opposing the nozzle surface 50*a* (or is separated by a distance greater than 5 mm from the nozzle surface 50*a*), and the maintenance unit 100 is rotated through 180°, whereupon the maintenance unit 100 is scanned (moved) in the opposite direction to the previous scanning direction in such a manner that a similar maintenance process to that in the outward path is carried out in the return path (homeward path).

For example, it is possible to adopt a mode in which the state of soiling of the nozzle surface is determined by using a determination device, such as a CCD, sensor, or the like, when the maintenance process in the outward path (the direction from left to right in FIG. 7A) has been completed, and if it is judged that the cleaning of the nozzle surface 50A is not sufficient, then the maintenance unit 100 is controlled so as to carry out a maintenance process on the return path also.

Figure 8:
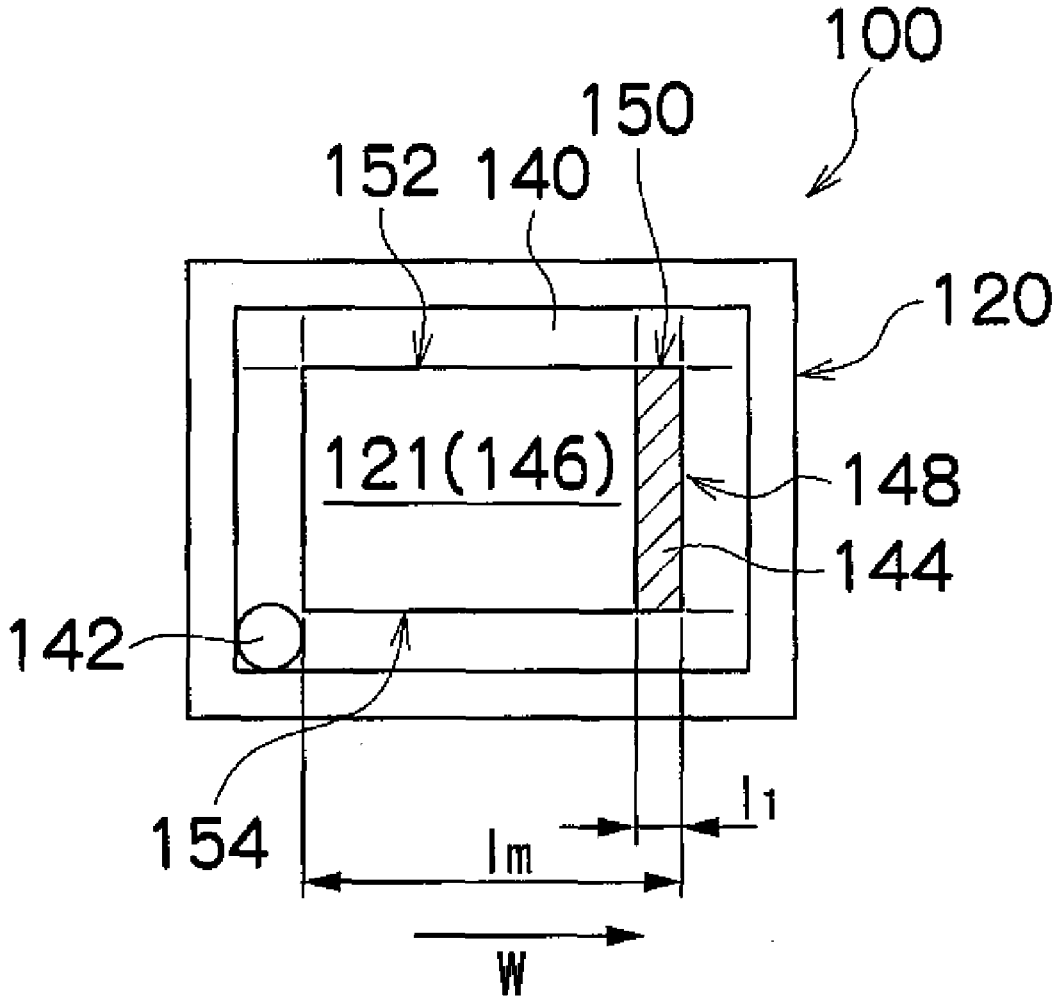
FIG. 8 is a general plan diagram of the ink storage member shown in FIGS. 7A and 7B.

The ink which overflows from the ink storage member 120 is recovered in an ink recovery channel provided on the outer perimeter portion of the ink storage member 120 (not illustrated in FIGS. 7A and 7B, and indicated by reference numeral 140 in FIG. 8). The details of the ink recovery channel are described later.

For the blade 124, it is suitable to use a member which has absorptive properties and which absorbs the ink adhering to the nozzle surface 50A, and a member which has sufficient rigidity to wipe off solidified material adhering to the nozzle surface 50A. Possible examples of a member to be used as the blade 124 of the present embodiment include a porous member and an elastic member made of rubber, for instance.

Furthermore, if a mechanism for raising and lowering the blade 124 independently is provided, then it is possible to alter the pressing force of the blade 124 against the nozzle surface 50A during the wiping of the nozzle surface 50A. For example, if there is a large amount of adhering material per unit surface area, or if there is adhering material exceeding a standard size, then this adhering material on the nozzle surface 50A can be removed effectively and reliably by increasing the relative pressing force of the blade 124.

In other words, the pressure force of the blade 124 is desirably controlled in accordance with the state of soiling of the nozzle surface 50A, in such a manner that if the state of soiling is greater than a standard level, then the pressing force of the blade 124 is also made greater than a standard force, and if the state of soiling is less than a standard level, the pressing force of the blade 124 is made smaller than a standard force. To give one example of determining the state of soiling of the nozzle surface 50A, there is a mode in which a CCD which captures images of the nozzle surface 50*a* is provided, and the soiling of the nozzle surface 50A is judged on the basis of the image results captured by the CCD.

An absorbing body 130 is formed with the end portion of the head 50 on the downstream side in the scanning direction W of the maintenance unit 100. When the maintenance unit 100 makes contact with the absorbing body 130 in the end portion of the head 50 on the downstream side in the scanning direction W of the maintenance unit 100, then the meniscus between the nozzle surface 50A and the ink storage member 120 breaks down, and the ink pool (ink 122) on the ink storage member 120 disappears.

Instead of the absorbing body 130, it is also possible to provide a hydrophilic treatment region having a surface area corresponding to the size of the ink holding surface 121, in the end portion of the head 50 on the downstream side in the scanning direction W of the maintenance unit 100. When the ink 122 present between the nozzle surface 50A and the ink storage member 120 makes contact with the hydrophilic treatment region, the meniscus between the nozzle surface 50A and the ink storage member 120 is broken down, a portion of the ink 122 adheres to the hydrophilic treatment region, and the remainder of the ink flows out to the ink expulsion channel (see FIG. 8). The ink adhering to the hydrophilic treatment region is wiped away by the blade 124.

In other words, by providing a member which has radically different wetting properties to the ink holding surface 121, in the end portion of the head 50 on the downstream side in the scanning direction W of the maintenance unit 100, the meniscus between the nozzle surface 50A and the ink holding surface 121 is caused to break down.

A desirable mode is one where a blade is provided instead of the absorbing body 130. The absorbing body 130 needs to be replaced when it has absorbed a certain amount of ink, but in a mode where a blade is provided instead of the absorbing body 130, or a mode where a portion of the nozzle surface 50A is formed as a hydrophilic treatment region, then maintenance (component replacement) is not necessary.

FIG. 8 is a general plan diagram showing the maintenance unit 100 as viewed from the side of the nozzle surface 50A. As shown in FIG. 8, the ink recovery channel 140 which recovers ink overflowing from the ink holding surface 121 is provided in the outer perimeter of the ink holding surface 121, and moreover, in the ink recovery channel 140, an outlet port 142 is provided through which ink recovered from the ink holding surface 121 is output to the exterior of the maintenance unit 100.

The ink recovery channel 140 is a groove having an opening of a prescribed width on the ink storage member 120 side (the upper surface), and is provided in a position below (in a lower position than) the surface on which the ink holding surface 121 is formed. Furthermore, the ink recovery channel 140 adopts a structure having an inclined surface which inclines towards the outlet port 142 in such a manner that the outlet port 142 is disposed in the lowest position of the ink recovery channel 140, so that the ink inside the ink recovery channel 140 flows to the outlet port 142 under its own weight. Furthermore, a water-repellent (liquid-repellent) treatment is provided on the ink recovery channel 140. The width of the ink recovery channel is desirably taken to be equal to or greater than 4 mm and equal to or less than 10 mm, and the height difference between the ink holding surface 121 and the ink recovery channel 140 is desirably set to a distance equal to or greater than 10 mm and equal to or less than 20 mm.

For the ink holding surface 121, it is suitable to use a non-permeable member which has ink resistant properties that prevent corrosion by ink, and which is also impermeable to ink. For example, plastic (resin), metal, rubber, and the like, are suitable for use as the ink holding surface 121.

Moreover, a hydrophilic treatment is provided on the ink holding surface 121. On the other hand, a hydrophobic (water-repellent) treatment region 144 is formed on the end portion of the ink holding surface 121 on the downstream side in the scanning direction W, and the vicinity thereof. In other words, a boundary between hydrophobic treatment and hydrophilic treatment is provided within a prescribed range from the end portion of the ink holding surface 121 on the downstream side in the scanning direction W.

The length $l_l$ of the hydrophobic treatment region 144 in the scanning direction W (the length from the end portion of the ink holding surface 121 on the downstream side in the scanning direction W until the boundary between the hydrophobic region and the hydrophilic region) is desirably kept to 10% or less of the whole of the length $l_m$ of the ink holding surface 121 in the scanning direction W. The boundary between the hydrophobic treatment and the hydrophilic treatment may be formed in the corner edge portion 150 of the boundary portion between the surface 146 which includes the ink holding surface 121 and the vertical surface 148 which is perpendicular to the surface 146 containing the ink holding surface 121 (a lyophobic treatment is provided on this surface 148).

In this way, by providing a hydrophilic treatment on the ink holding surface 121, the ink spreads and wets uniformly, and improvement in the wiping performance of the maintenance unit 100 (the efficiency of wetting the nozzle surface) can be anticipated. On the other hand, by providing a hydrophobic treatment in a prescribed range from the end portion of the ink holding surface 121 on the downstream side of the scanning direction W, the ink held on the ink holding surface 121 is prevented from leaking out beyond the end portion on the downstream side in the scanning direction W, and the ink is held stably on the ink holding surface 121.

Furthermore, if a hydrophobic treatment is provided (if a boundary between hydrophilic treatment and hydrophilic treatment is formed) in each of both end portions 152, 154 of the ink holding surface 121 which are parallel to the scanning direction W, then this is more desirable since it prevents the ink from leaking out from the both end portions 152, 154 which are parallel to the scanning direction W.

The "hydrophobic treatment" mentioned in the present embodiment refers to a state where the angle of contact of the ink with respect to the ink holding surface 121 is 45° or greater, and the "hydrophilic treatment" refers to a state where the angle of contact of the ink with respect to the ink holding surface 121 is less than 30°.

Figure 9:
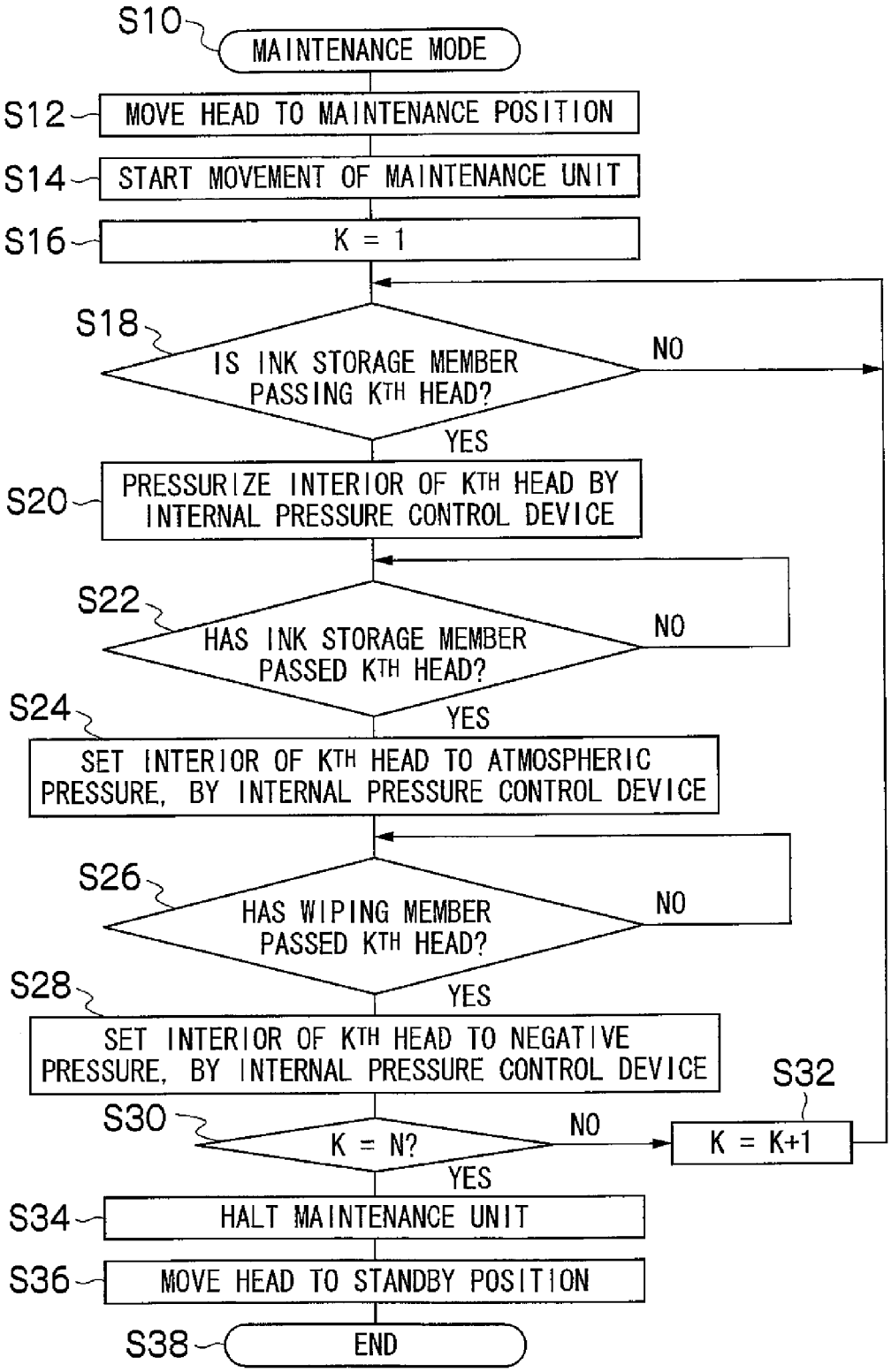
FIG. 9 is a flowchart showing a control sequence of a nozzle surface maintenance method relating to an embodiment of the present invention.

FIG. 9 shows a flowchart of a method of maintaining the nozzle surface 50A of the head 50 according to an embodiment of the present invention. When the operational mode of the inkjet recording apparatus 10 transfers to maintenance mode (step S10), the head 50 is moved to the maintenance position (step S12), and the maintenance unit 100 is moved to a maintenance start position directly below the head 50 (a position directly below the head block 50-1 as shown in FIG. 7A).

In step S14, when the maintenance unit 100 is disposed at the maintenance start position in the end portion of the first head block 50-1 on the upstream side in the scanning direction W, then a maintenance process for the nozzle surface 50A of the first head block 50-1 is carried out.

In other words, a value of one (1) is assigned to the head block number K (i.e. K=1) (step S16), the maintenance unit 100 starts scanning (moving), and the position of the ink storage member 120 is monitored in terms of the scanning direction W (step S18).

In step S18, if it is judged that the ink storage member 120 is not passing below the head block 50-1 (the head block subject to maintenance processing) (namely, if the ink storage member 120 is not positioned below the head block subject to maintenance processing) (NO verdict), then the monitoring of the position of the ink storage member 120 is continued (step S18), whereas if it is judged that the ink storage member 120 is passing below the first head block 50-1 (YES verdict), then the pump 69-1 provided for the sub tank 61-1 which is connected to the head block 50-1 is operated, the internal pressure of the head block 50-1 is changed to a positive pressure, and ink is supplied from the head block 50-1 to the ink storage member 120 (step S20).

The pressurization timing of the sub tank 61-1 (the sub tank corresponding to the head block subject to maintenance processing) is determined in accordance with the volume of the sub tank 61-1 and the capacity of the pump 69-1. In other words, the time period from the start of pressurization of the sub tank 61-1 until ink starts to flow out from the nozzles of the head block 50-1 is ascertained in advance, and the pressurization timing of the sub tank 61-1 is specified by referring to the time period from the pressurization of the sub tank 61-1 until the ink starts to flow out from the nozzles of the head block 50-1. Furthermore, when ink is supplied from the first head block 50-1 to the ink storage member 120, it is desirable to make complementary use of pressurization by the piezoelectric elements 58.

When ink is supplied from the first head block 50-1 to the ink storage member 120, since no ink is present on the ink storage member 120, it may not be possible to cause ink to flow out from the nozzles simply by setting the internal pressure of the head block 50-1 to a positive pressure. This phenomenon is particularly marked in cases where an ink of high viscosity is used.

Consequently, by making complementary use of pressurization by the piezoelectric elements 58, it is possible to cause the ink to flow out from the nozzles more reliably. Furthermore, it is also possible to change the internal pressure in accordance with the viscosity of the ink used, in such a manner that if the viscosity of the ink is relatively high, the internal pressure is made relatively higher.

When ink is supplied from the head block 50-1 to the ink storage member 120, the ink spreads between the nozzle surface 50A and the ink storage member 120, due to capillary action, and the nozzle surface 50A of the head block 50-1 is thereby wetted by the ink. The ink between the nozzle surface 50A and the ink storage member 120 dissolves (redistributes) the ink of increased viscosity which is attached to the nozzle surface 50A, and causes the dirt, paper dust, and the like, to float away from the nozzle surface 50A.

While the ink storage member 120 is passing below the head block 50-1, it is judged whether or not the ink storage member 120 has passed below the head block 50-1 (step S22).

In step S22, if it is judged that the ink storage member 120 is passing below the head block 50-1 (NO verdict), then the judgment of whether or not the ink storage member 120 has passed below the head block 50-1 is continued (step S22), and when it is judged that the ink storage member 120 has passed below the head block 50-1 (YES verdict), the pump 69-1 provided for the sub tank 61-1 which is connected to the head block 50-1 is operated, and the internal pressure of the head block 50-1 is changed to atmospheric pressure (step S24).

At step S24, if the ink storage member 120 has passed below the head block 50-1 (if wetting of the head block 50-1 has been completed), then the internal pressure of the head block 50-1 is controlled so as to descend from a positive pressure to atmospheric pressure. The internal pressure of the head block 50-1 may be changed to a negative pressure (the pressure before the maintenance process), but by setting the internal pressure of the head block 50-1 to atmospheric pressure, then the beneficial effects of the maintenance process are enhanced, without the ink or air bubbles that are attached to the nozzle surface 50*a* flowing in reverse back into the nozzles. At step S24, when the internal pressure of the head block 50-1 is changed to atmospheric pressure, the position of the blade (wiping member) 124 is monitored (step S26).

At step S26, if it is judged that the blade 124 is passing below the head block 50-1 and a process of wiping the nozzle surface 50A of the head block 50-1 is in progress (NO verdict), then the monitoring of the position of the blade 124 is continued (step S26). If, on the other hand, it is judged that the blade 124 has passed below the head block 50-1 and that the wiping process has been completed (YES verdict), then the internal pressure of the head block 50-1 is changed to a negative pressure (step S28), and the procedure then advances to step S30.

At step S30, it is judged whether or not the head block for which the maintenance processing has been completed is the last head block 50-N (whether or not K=N). At step S30, if it is judged that K is not equal to N (NO verdict), then the procedure advances to step S32, and transfers to processing of the next head block (K+1$^{th}$ head block). In other words, K+1 is substituted for K, the procedure advances to step S18, and the steps from S18 to S30 are repeated in respect of the head blocks 50-K from the second head block 50-2 onwards.

When ink is supplied from the second or subsequent head block 50-K to the ink storage member 120, then since there is ink on the ink storage member 120, it is possible to cause ink to flow out from the nozzles by pressurizing the ink inside the nozzles in such a manner that ink inside the nozzles comes into contact with the ink on the ink storage member 120. Consequently, even if complementary use of pressurization by the piezoelectric elements 58 is not employed, it is still possible to supply ink to the ink storage member 120 simply by changing the internal pressure of the head block 50-K.

On the other hand, at step S30, if it is judged that K=N (that the maintenance process for the last head block 50-N has been completed) (YES verdict), then the operation of the maintenance unit 100 is halted (step S34), the head 50 is moved to a standby position (step S36), and the maintenance process control procedure ends (step S38).

In the present example, a mode which pressurizes the sub tank 60-K is described as a method of supplying ink to the ink storage member 120, but it is also possible to adopt a mode which supplies ink to the ink storage member 120 by pressurization by means of the piezoelectric elements 58. When pressurization by the piezoelectric elements 58 is used for supplying ink to the ink storage member 120, there is a problem with regard to whether the amount of ink required to wet the nozzle surface 50A can be supplied to the ink storage member 120.

For example, the head used has a capacity to eject ink droplets of a maximum size of 10 pl during one ejection operation, at an ejection frequency of 20 kHz. If the length $l_m$ of the ink holding surface 121 in the lengthwise direction of the head is 60 mm ($l_m$=60 mm), the length $l_s$ of the ink holding surface 121 in the breadthways direction of the head is 40 mm ($l_s$=40 mm), and the ejection resolution is 2400 dpi (herein, converted to a number of nozzles per inch), then the number of nozzles directly above the ink holding surface 121 is approximately 5800. Furthermore, if the clearance between the nozzle surface 50A and the ink holding surface 121 is 2 mm, then the volume of the space between the nozzle surface 50A and the ink holding surface 121 is 480 mm$^3$=0.48 ml.

The head having the liquid supply capability described above is able to supply ink of a volume of 10 (pl)×5800 (nozzles)/50 (μsec)≈1 (ml) per second, to the space between the nozzle surface 50A and the ink holding surface 121 described above, and this value is sufficiently large with respect to the volume of the space between the nozzle surface 50A and the ink holding surface 121. Consequently, it is possible to supply the amount of ink required for wetting the nozzle surface 50A, by means of a head which satisfies the conditions described above.

When pressurization by the piezoelectric elements 58 is used to supply ink to the ink storage member 120, then the sub tanks 61-K and the pumps 69-K which are used to change the internal pressure, can be omitted.

Since the clearance between the nozzle surface 50A and the ink storage member 120 is relatively small, then there is a concern that the flow of ink between the nozzle surface 50A and the ink storage member 120 may deteriorate and the efficiency in removing adhering material from the nozzle surface 50A may become worse. Therefore, the state of soiling of the nozzle surface 50A is determined by means of a sensor, such as a CCD, and if the amount of adhering material on the nozzle surface 50A is high (if the degree of soiling on the nozzle surface 50A is great), then the vertical movement mechanism 104 of the ink storage member 120 is desirably operated in such a manner that the clearance between the nozzle surface 50A and the ink storage member 120 becomes relatively larger.

The inkjet recording apparatus 10 having the composition described above is composed in such a manner that ink is supplied from the head 50 to the ink storage member 120, which is disposed in a position opposing the nozzle surface 50A of the full line head 50 while maintaining a prescribed distance from the nozzle surface 50A, and the ink storage member 120 is scanned (moved) in the lengthwise direction of the head 50. Consequently, the nozzle surface 50A can be wetted in a short period of time by means of the ink between the nozzle surface 50A and the ink storage member 120. Even in a case where a long head (line head) having a width corresponding to the recordable width of the recording paper 16, it is possible to wet the whole of the nozzle surface 50A of the head 50 by causing a relative scanning (moving) between the head 50 and the maintenance unit 100, just once, in the lengthwise direction of the head 50.

Moreover, since fresh ink is supplied from the head 50 in accordance with the movement of the ink storage member 120, then there is no concentration of soiling between the nozzle surface 50A and the ink storage member 120, and the dissolution time of the adhering material which is attached to the nozzle surface 50A is shortened.

Furthermore, since a hydrophilic treatment is provided on the ink holding surface 121 of the ink storage member 120, the ink is held reliably on the ink holding surface 121. Moreover, by providing a lyophobic treatment region 144 in the end portion and the vicinity of the ink holding surface 121 on the downstream side of the ink holding surface 121 in the scanning direction of the maintenance unit 100, the ink is caused to flow more readily to the end portion of the ink holding surface 121 on the upstream side in the scanning direction W of the maintenance unit 100. Consequently, the recovery of surplus ink is facilitated, and furthermore, leaking of ink from the end portion of the ink holding surface 121 on the downstream side in the scanning direction W of the maintenance unit 100 is prevented.

Adaptation Example

Figure 10:
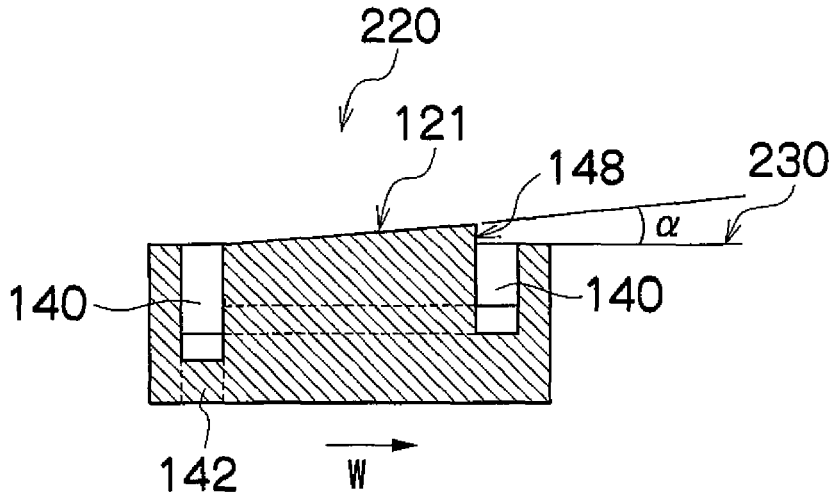
FIG. 10 is a cross-sectional diagram showing the structure of an ink storage member according to an adaptation of an embodiment of the present invention.
Figure 11:
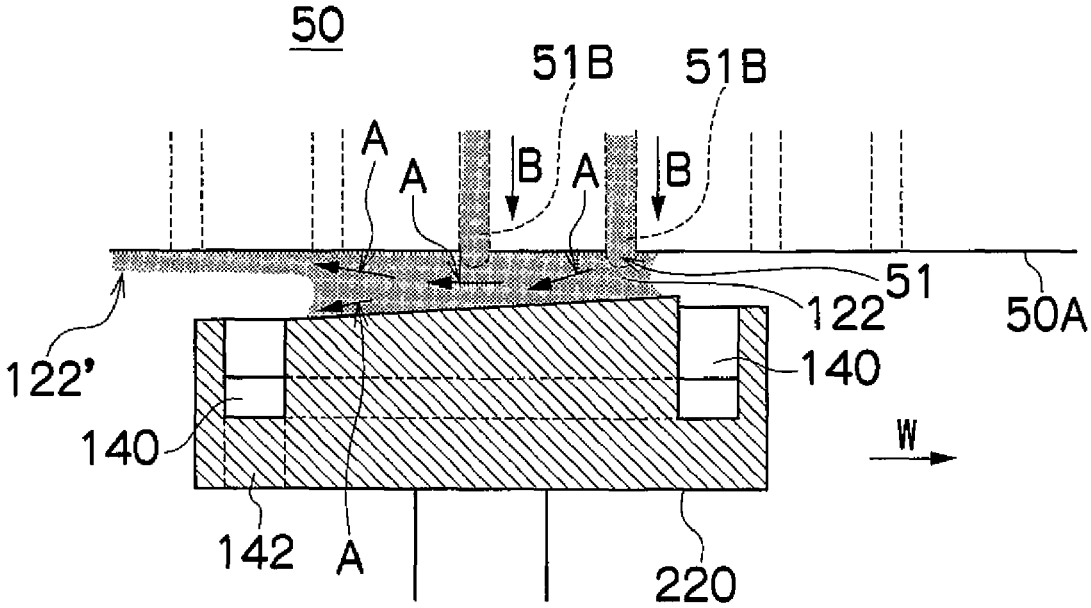
FIG. 11 is an illustrative diagram of a nozzle surface maintenance method relating to an adaptation of an embodiment of the present invention.

Next, an adaptation example relating to the present embodiment is described with reference to FIG. 10 and FIG. 11. FIG. 10 is a cross-sectional diagram showing the structure of the ink storage member 220 according to the present example. Furthermore, FIG. 11 shows a schematic drawing of a state where ink is supplied from the head 50 to the ink storage member 220 shown in FIG. 10. In this adaptation example, parts which are the same as or similar to those of the first embodiment described above are labelled with the same reference numerals and further explanation thereof is omitted here.

The ink storage member 220 shown in FIG. 10 is inclined at an angle in such a manner that the ink holding surface 121 becomes lower gradually, from the downstream side to the upstream side in terms of the scanning direction W of the maintenance unit 100 (from the right-hand side to the left-hand side in FIG. 10).

As shown in FIG. 11, by adopting a composition in which the distance between the nozzle surface 50A and the intermediate transfer body 120 (ink holding surface 121) becomes gradually narrower, from the upstream side toward the downstream side in terms of the scanning direction W, then the meniscus formed between the nozzle surface 50A and the ink holding surface 121 becomes more difficult to break down, and therefore ink 122 can be stored on the ink holding surface 121 even if the ink 122 stored on the ink holding surface 121 is affected by the displacement of the nozzle surface 50A or the air flow (air current) created by the movement of the maintenance unit 100, when the maintenance unit 100 is moved.

Furthermore, by providing the ink holding surface 121 with a tilt (inclined surface), the flow of ink from the downstream side to the upstream side in terms of the scanning direction W (the flow indicated by reference numeral A in FIG. 11) is stabilized, and furthermore, the ink overflowing from the ink holding surface 121 can flow to the ink recovery channel 140 by following the inclination of the ink holding surface 121. Therefore, ink is prevented from leaking to the downstream side in the scanning direction of the maintenance unit 100, and new ink supplied from the head 50 via the nozzles 51 is held on the ink holding surface 121.

In FIG. 11, the direction of flow of the ink from the nozzles 51B which supply ink to the ink storage member 120 (i.e. from the pressurized nozzles) is indicated by reference numeral B. Furthermore, the ink which wets the nozzle surface 50A is indicated by reference numeral 122'.

A desirable mode is one where the angle $\alpha$ between the ink holding surface 121 and the horizontal surface 230 is equal to or greater than 5° and less than 30°, when the distance between the nozzle surface 50A and the ink holding surface 121 is in a range of being equal to or greater than 1 mm and equal to or less than 5 mm.

FIG. 10 and FIG. 11 show a mode where the whole of the ink holding surface 121 is formed as an inclined surface, but it is also possible to form a portion of the ink holding surface 121 as an inclined surface, for example, from the end portion of the ink holding surface 121 on the downstream side in the scanning direction W until the central portion of the ink holding surface 121. Moreover, a desirable mode is one in which a hydrophobic treatment region (see FIG. 8) is provided in the uppermost portion of the inclined surface formed in the ink holding surface 121. Furthermore, it is possible that the ink holding surface 121 is constituted by a horizontal surface and the whole of the ink storage member 120 is inclined.

Second Embodiment

Figure 12:
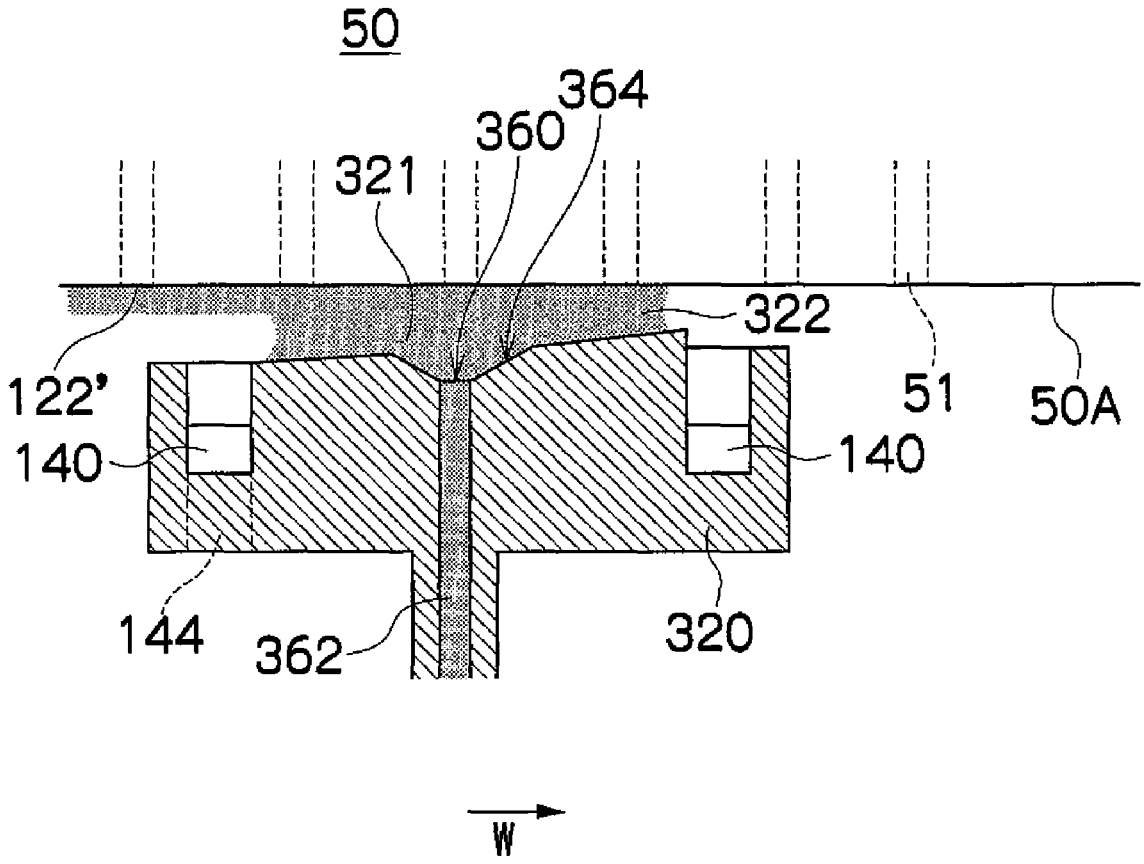
FIG. 12 is a cross-sectional diagram showing the structure of an ink storage member relating to a second embodiment of the present invention.

Next, a second embodiment of the present invention will be described with reference to FIG. 12. FIG. 12 shows an ink storage member 320 relating to the second embodiment.

As shown in FIG. 12, a cleaning liquid supply port 360 which supplies cleaning liquid 322 for wetting the nozzle surface 50A is provided in the approximate central portion of the ink holding surface 321 of the ink storage member 320.

In other words, the ink storage member 320 comprises a cleaning liquid supply port 360 formed in the approximate central portion of the ink holding surface 321, a cleaning liquid supply channel 362 which is connected to the cleaning liquid supply port 360, a cleaning liquid tank (not illustrated) which stores the cleaning liquid, and a liquid supply apparatus (not illustrated), such as a pump, which sends the cleaning liquid to the cleaning liquid supply port 360.

In the ink storage member 320 shown in FIG. 12, cleaning liquid 322 is supplied to the ink holding surface 321 from the cleaning liquid supply tank (not illustrated), via the cleaning liquid supply channel 362 and the cleaning liquid supply port 360. It is possible for the supply of cleaning liquid to the ink storage member 320 to be carried out continuously or to be carried out in an intermittent fashion.

Water (pure water), ink (transparent ink which does not contain any coloring material), or the like, is suitable for use as the cleaning liquid for wetting the nozzle surface 50A. Of course, it is also possible to use a liquid other than water and ink, provided that it has the function of dissolving the ink of increased viscosity adhering to the nozzle surface 50A and the function of separating the dirt and paper dust attached to the nozzle surface 50A, as well as being removable from the nozzle surface 50A by means of a wiping process by the blade 124.

As shown in FIG. 12, a recess section 364 is formed about the perimeter of the cleaning liquid supply port 360 which is provided in the ink holding surface 321. The cleaning liquid supply port 360 may be provided to the downstream side of the central portion of the ink holding surface 321, in terms of the scanning direction W. Furthermore, a desirable mode is one in which a plurality of cleaning liquid supply ports 360 are provided.

According to the second embodiment of the present invention, it is not necessary to supply ink from the head 50 to the ink storage unit 320, and furthermore, since the nozzle surface 50A is wetted by means of the cleaning liquid having excellent cleaning properties, then it is possible to improve the maintenance efficiency.

In the present example, an inkjet recording apparatus which forms a color image on a recording medium is described as one example of a liquid ejection apparatus to which a cleaning apparatus relating to the present invention can be applied, but the present invention can also be applied broadly to other liquid ejection apparatuses, such as a dispenser.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A maintenance apparatus for a nozzle surface in which a plurality of nozzles ejecting a liquid are formed, in an ejection head having a nozzle row in which the nozzles are aligned in a main scanning direction, the maintenance apparatus comprising:

a liquid storage member which is disposed in a position opposing the nozzle surface of the ejection head at a prescribed distance from the nozzle surface, and which has a liquid holding surface which has a length, in a sub-scanning direction perpendicular to the main scanning direction, corresponding to a length in the sub-scanning direction of a nozzle arrangement region in which the plurality of nozzles are provided;

a liquid supply device which supplies a liquid to the liquid holding surface;

a movement device which moves the liquid storage member through a whole length of the nozzle row in the main scanning direction, while bringing the liquid held on the liquid holding surface into contact with the nozzle surface without bringing the liquid holding surface into contact with the nozzle surface; and a wiping device which wipes the nozzle surface that has been wetted by the liquid supplied to the liquid storage member, while moving subsequently to the liquid storage member, to remove adhering material attached to the nozzle surface.

2. The maintenance apparatus as defined in claim 1, wherein the liquid holding surface has a supply port through which the liquid supplied from the liquid supply device is sent.

3. The maintenance apparatus as defined in claim 1, wherein the liquid supply device comprises the ejection head.

4. The maintenance apparatus as defined in claim 1, wherein the liquid holding surface has an inclined surface of a structure in which a distance from the nozzle surface in an end portion of the liquid holding surface on an upstream side in terms of a direction of movement of the liquid storage member is greater than a distance from the nozzle surface in an end portion of the liquid holding surface on a downstream side in terms of the direction of the movement of the liquid storage member.

5. The maintenance apparatus as defined in claim 1, wherein the liquid storage member comprises a liquid recovery channel which is provided in at least an end portion of the liquid holding surface on an upstream side in terms of a direction of movement of the liquid storage member and which recovers the liquid supplied to the liquid holding surface.

6. The maintenance apparatus as defined in claim 1, wherein the liquid holding surface is provided at least partially with a lyophilic treatment.

7. The maintenance apparatus as defined in claim 1, wherein a hydrophobic treatment is provided on an end portion of the liquid holding surface on a downstream side in terms of a direction of movement of the liquid storage member.

8. A liquid ejection apparatus, comprising:

an ejection head having a nozzle surface in which a plurality of nozzles ejecting a liquid are formed and a nozzle row in which the nozzles are aligned in a main scanning direction;

a liquid storage member which is disposed in a position opposing the nozzle surface of the ejection head at a prescribed distance from the nozzle surface, and which has a liquid holding surface which has a length, in a sub-scanning direction perpendicular to the main scanning direction, corresponding to a length in the sub-scanning direction of a nozzle arrangement region in which the plurality of nozzles are provided;

a movement device which moves the liquid storage member through a whole length of the nozzle row in the main scanning direction, while bringing a liquid supplied from the ejection head and held on the liquid holding surface, into contact with the nozzle surface without bringing the liquid holding surface into contact with the nozzle surface; and a wiping device which wipes the nozzle surface that has been wetted by the liquid supplied to the liquid storage member, while moving subsequently to the liquid storage member, to remove adhering material attached to the nozzle surface.

9. The liquid ejection apparatus as defined in claim 8, wherein the ejection head comprises a line type ejection head which has at least one nozzle row in which the nozzles which eject the liquid are arranged in the main scanning direction through a length corresponding to a length of one edge of an ejection receiving medium.

10. The liquid ejection apparatus as defined in claim 8, further comprising:

an internal pressure modification device which adjusts an internal pressure of the ejection head; and an internal pressure control device which controls the internal pressure modification device in such a manner that the internal pressure of the ejection head is set to a positive pressure when the liquid is supplied from the ejection head to the liquid storage member.

11. The liquid ejection apparatus as defined in claim 10, wherein the internal pressure modification device comprises:

a sub tank connected to the ejection head; and a pressurization device which pressurizes a liquid in the sub tank.

12. The liquid ejection apparatus as defined in claim 8, further comprising:

ejection force application devices which are provided for the plurality of nozzles respectively, and which respectively apply ejection forces to the liquid in the plurality of nozzles; and an ejection control device which controls operation of the ejection force application devices in such a manner that when the liquid is supplied from the ejection head to the liquid storage member, the liquid is supplied to the liquid storage member via the nozzles.

13. The liquid ejection apparatus as defined in claim 12, wherein the ejection control device controls the ejection force application devices in such a manner that the liquid is ejected onto the liquid storage member selectively from the nozzles on a downstream side in terms of a direction of movement of the liquid storage member.

14. The liquid ejection apparatus as defined in claim 10, wherein:

the ejection head includes a plurality of head blocks aligned in the main scanning direction, and the internal pressure modification devices are provided for the plurality of head blocks respectively; and the internal pressure control device which controls the internal pressure modification devices provided for the plurality of head blocks respectively, in such a manner that the liquid is supplied to the liquid storage member from the head block directly below which the liquid storage member is positioned.

15. The liquid ejection apparatus as defined in claim 14, wherein the internal pressure control device controls the internal pressure modification devices to set an internal pressure of the head block from which the liquid is caused to flow out from the nozzles, to a positive pressure, and to set an internal pressure of the head block which is wiped by the wiping device to atmospheric pressure.

16. A maintenance method for a nozzle surface in which a plurality of nozzles are formed, in an ejection head having a nozzle row in which the nozzles ejecting a liquid are arranged in a main scanning direction, the maintenance method comprising the steps of:

supplying a liquid to a liquid storage member which is disposed at a position opposing the nozzle surface at a prescribed distance from the nozzle surface, and which comprises a liquid holding surface having a length, in a sub-scanning direction perpendicular to the main scanning direction, corresponding to a length in the sub-scanning direction of a nozzle arrangement region in which the plurality of nozzles are arranged; and moving the liquid storage member through a whole length of the nozzle row in the main scanning direction while causing the liquid held on the liquid holding surface to make contact with the nozzle surface without bringing the liquid holding surface into contact with the nozzle surface, and wiping the nozzle arrangement region of the nozzle surface which has been wetted by the liquid supplied to the liquid storage member, to remove adhering material attached to the nozzle surface.

17. The maintenance method as defined in claim 16, wherein in the moving step, a distance between the nozzle surface and the liquid holding surface is kept to be not smaller than 1 mm and not larger than 5 mm.

18. The maintenance apparatus as defined in claim 1, wherein the liquid supply device forms a layer of the liquid between the nozzle surface and the liquid holding surface.

19. The maintenance apparatus as defined in claim 1, wherein when the movement device moves the liquid storage member through the whole length of the nozzle row in the main scanning direction, a distance between the nozzle surface and the liquid holding surface is kept to be not smaller than 1 mm and not larger than 5 mm.

20. The liquid ejection apparatus as defined in claim 8, wherein when the movement device moves the liquid storage member through the whole length of the nozzle row in the main scanning direction, a distance between the nozzle surface and the liquid holding surface is kept to be not smaller than 1 mm and not larger than 5 mm.

* * * * *